US007812726B2

(12) United States Patent
Barlow, Jr. et al.

(10) Patent No.: US 7,812,726 B2
(45) Date of Patent: Oct. 12, 2010

(54) TAMPER EVENT DETECTION FILMS, SYSTEMS AND METHODS

(75) Inventors: William J. Barlow, Jr., Yorktown, VA (US); W. Douglas Lilac, Williamsburg, VA (US); Jeffrey A. Middlesworth, Wauconda, IL (US); Keith Nelson, Chippewa Falls, WI (US)

(73) Assignee: Pliant Corporation, Schaumburg, IL (US)

( * ) Notice: Subject to any disclaimer, the term of this patent is extended or adjusted under 35 U.S.C. 154(b) by 552 days.

(21) Appl. No.: 11/835,265

(22) Filed: Aug. 7, 2007

(65) Prior Publication Data

US 2008/0075934 A1 Mar. 27, 2008

Related U.S. Application Data

(60) Provisional application No. 60/836,047, filed on Aug. 7, 2006.

(51) Int. Cl.
*G08B 13/14* (2006.01)

(52) U.S. Cl. ..... 340/572.1; 340/531

(58) Field of Classification Search ... 340/572.1–572.8, 340/10.1, 531

See application file for complete search history.

(56) References Cited

U.S. PATENT DOCUMENTS

| | | | | |
|---|---|---|---|---|
| 4,806,422 | A | 2/1989 | Ohno et al. | |
| 5,108,530 | A | 4/1992 | Niebling, Jr. et al. | |
| 5,763,058 | A | 6/1998 | Isen et al. | |
| 6,018,299 | A | 1/2000 | Eberhardt | |
| 6,107,920 | A | 8/2000 | Eberhardt et al. | |
| 6,421,013 | B1 | 7/2002 | Chung | |
| 6,794,000 | B2 * | 9/2004 | Adams et al. | 428/40.1 |
| 6,814,287 | B1 | 11/2004 | Chang et al. | |
| 6,824,857 | B2 | 11/2004 | Lochun et al. | |
| 6,888,509 | B2 | 5/2005 | Atherton | |
| 7,049,962 | B2 * | 5/2006 | Atherton et al. | 340/572.1 |
| 7,095,324 | B2 * | 8/2006 | Conwell et al. | 340/572.1 |
| 7,274,289 | B2 * | 9/2007 | Kerr et al. | 340/500 |

(Continued)

OTHER PUBLICATIONS

International Preliminary Report on Patentability corresponding to International Application Serial No. PCT/US2007/075384, mailed Feb. 19, 2009.

(Continued)

*Primary Examiner*—Eric M Blount
(74) *Attorney, Agent, or Firm*—McAndrews, Held & Malloy, Ltd.

(57) ABSTRACT

The present technology relates to tamper evident films, systems and methods for detecting tamper events in films or film packages. The present technology is especially useful in applications for detecting tamper events with individually packaged goods, as well as with bulk packaging or wrapped pallets in circumstances where visual inspection is hampered or prevented. In one or more preferred systems, films and methods of the present technology utilize a conductive pattern, a sensor and/or alarm circuit, and a wrapping film, such as a stretch film, shrink wrap, bagging or stretchhooder. In at least one particularly preferred embodiment, films of the present technology are stretch films having conductive ink patterns applied thereto that remain conductive when the films are stretched to a percent stretch of about 1% or greater. In other embodiments, a conductive material can be separately wrapped and/or cowrapped in conjunction with a film. Preferred tamper detection systems of the present technology also utilize radio frequency identification technology to indicate whether a tamper event has occurred.

14 Claims, 12 Drawing Sheets

U.S. PATENT DOCUMENTS

| | | | | |
|---|---|---|---|---|
| 7,382,262 | B2 * | 6/2008 | Commagnac et al. | 340/572.1 |
| 2002/0135481 | A1 * | 9/2002 | Conwell et al. | 340/572.1 |

OTHER PUBLICATIONS

International Search Report corresponding to International Application Serial No. PCT/US2007/075384, mailed May 15, 2008, 3 pages.
Written Opinion of the International Searching Authority corresponding to International Application Serial No. PCT/US2007/075384, mailed May 15, 2008, 7 pages.
Jay Sperry, Eric Weisenmiller, Conductive Inks and In-Line Flexo, An Investigation of Process Benchmarks for RFID Printing, FLEXO Magazine, Jan. 2006, 6pp.
A. Karwa, Yu Xia, D.M. Clark, T.W. Smith, B.E. Kahn, Printable Electronics: Patterning of Conductive Materials for Novel Applications, Materials Research Society Symposium Proceedings, 2005.
Tom Judge, Examining the Future of Printed RFID Tags: Utilising Conductive Inks, PIRA International Conference Proceedings, 2004.
P. Berry, G. Butch, Conductive Inks for Flex Circuits, Printed Circuit Design & Manufacture, Mar. 2005.

* cited by examiner

Compression Load vs. log (t);0.6 mil Stretch Wrap Films

TAMPER EVENT DETECTION FILMS, SYSTEMS AND METHODS

RELATED APPLICATIONS

This application makes reference to, claims priority to, and claims the benefit of U.S. Provisional Patent Application Ser. No. 60/836,047, entitled "Tamper Event Detection Films, Systems and Methods," filed on Aug. 7, 2006, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

The present technology generally relates to tamper evident films, systems, and methods for detecting a tamper event, for example, in packaging and shipping products and/or applications. In one or more preferred embodiments, the present technology relates generally to unique tamper event detection films, systems, and methods utilizing at least one stretch film, a conductive ink or ink pattern that remains conductive when applied in some manner to the stretch film, and at least one radio frequency identification (RFID) component.

BACKGROUND OF THE INVENTION

The shipping and packaging industries often use films to package and wrap goods for shipment, transportation, distribution, and storage. For example, multiple containers of goods are often stacked on pallets and a film is then wrapped around the containers to secure them to each other and/or to the pallet.

During shipment, transportation, distribution, and storage, however, goods can be exposed to tampering. For example, the film wrapped around a pallet may be partially cut open and containers of goods may be removed. Alternatively, a container within a wrapped pallet may also be opened and the goods contained therein may be removed. In such instances, the undamaged film on the pallet may still function to secure the other goods, and it can be difficult to visually determine that a tamper event has occurred without close inspection of the entire pallet. In applications where multiple pallets are transported or stored together, tamper detection by visual inspection becomes even more difficult, time consuming and costly.

BRIEF SUMMARY OF THE INVENTION

The present technology generally relates to films, systems and methods for detecting a tamper event in a film, package, or other end use application. The present technology can be used, for example, for detecting tamper events in industries such as the shipping and packaging industries, particularly where visual inspection is hampered, prevented, or is otherwise difficult to perform.

Possible applications of the present technology include, without limitation, pallet security, inventory control, tamper evidency, product tracking logistics, product allocation, and asset management. Preferably, the present technology is utilized for purposes of tamper evidency. One or more preferred systems, films and methods of the present technology utilize a conductive pattern, such as a series of wires or a pattern of conductive ink; a sensor and/or alarm circuit; and a wrapping film, such as a stretch film, shrink wrap, bagging or stretch-hooder. For example, in at least one preferred embodiment, the present technology provides a stretch film, a conductive ink or ink pattern applied to the stretch film that remains conductive when the film is stretched, and an alarm circuit or sensor to detect a tamper event. In at least another preferred embodiment, a film that does not stretch significantly is utilized, and at least one sheet of film having a printed conductive pattern thereon can be draped or wrapped around goods on a pallet. In yet another preferred embodiment, a series of wires or wire netting can be applied to goods on a pallet, and a shrink wrap, bag or hooder can be utilized on the inside or the outside of the wires to wrap the goods.

In addition to providing ways for efficient tracking and asset management, at least some embodiments of the present technology also provide higher efficiencies during inspection processing by providing information with respect to the occurrence of tamper events under circumstances where visual tamper evaluation is hampered or is otherwise difficult to perform.

Tamper events that can be detected using various embodiments of the present technology include events that damage or disassemble films or film packaging of the present technology. Examples of such tamper events include, without limitation, removal of an object within a load, punctures, cuts, and tears of any sort. Tamper events can occur with respect to any type of wrapped goods, such as individual packages or palleted goods.

In at least one aspect, the present technology provides a conductive material that is wrapped around packaged or palleted goods. In at least one embodiment, for example, the conductive material can be wires that are connected to form a series loop. In such an embodiment, it is preferred that the conductive material be applied to the goods, and then a wrapping film can be utilized to enclose both the conductive material and the goods. In at least another embodiment, the present technology provides a tamper evident film comprising at least one film having at least one conductive ink or ink pattern applied thereto. More preferably, the film is a stretch film and the conductive ink or ink pattern remains conductive when the film is at a percent stretch of about 1% or greater. As used herein the term "applied thereto" means that the conductive ink or ink pattern may be applied in any manner such that the ink is disposed on or in a monolayer film; or on, in or between one or more layers of a multilayer film. For example, the conductive ink or ink pattern can be applied onto the surface of a film, within a layer of a film, and between layers of a film.

Methods of applying the conductive ink or ink pattern to the stretch films of the present technology can include, without limitation, all forms of printing (e.g., gravure printing, flexographic printing), spraying, injecting, and curing, etc. Preferably, the conductive ink or ink pattern is applied to the stretch film via a photonically cured process such as that commercially offered by Nanotechnologies, Inc. (d.b.a. NovaCentrix Corporation) (Austin, Tex.) and further described in published PCT Patent Application Nos. WO2003106094, WO2005031974, WO2005080042, and WO2006,071419, the disclosures of which are herein incorporated by reference in their entirety.

Film(s) suitable for use as tamper evident films in the practice of the present technology can be monolayer or multilayer films. Suitable films can include, for example, stretch films, shrink wrap, bagging, stretch hooders, and any other suitable wrapping film. In at least one preferred embodiment, the tamper evident film is a multilayer film and the conductive ink is applied on or in at least one layer of the film. In embodiments where the conductive ink is on at least one layer of a multilayer film, the conductive ink can be, for example, on the outer surface of the film, or can be between layers of the film. In some particularly preferred embodiments, the film is a multilayer stretch film.

In preferred embodiments utilizing conductive ink, the conductive ink forms a conductive ink pattern comprising at least one continuous trace. The term trace as used herein refers to at least one line or trail of conductive ink on or within at least one film or film layer. Preferably, the continuous trace of conductive ink forms one component of a closed circuit through which current flows during operation of a tamper detection system of the present technology. Accordingly, it is also preferred that the conductive ink trace(s) form solid, or substantially unbroken, lines or trails, such that current can flow along or through the trace (e.g., to form or partially form a closed electrically conductive circuit).

In another aspect, the present technology provides one or more systems for detecting tamper events in films and/or film packaging. For example, in at least one embodiment, the present technology provides a system for detecting a tamper event in a film comprising at least one film having a conductive material applied thereto, at least one sensor in operative contact with the conductive material, at least one reader in operative communication with the sensor for detecting a tamper event, and at least one power source that generates a current through the conductive material. In at least another embodiment, the present technology provides a system for detecting a tamper event in a film comprising at least one stretch film having at least one conductive ink pattern applied thereto that remains conductive when the stretch film is at a percent stretch of about 1% or greater, more preferably at a percent stretch of from about 1% to about 400%; at least one sensor operatively connected to the conductive ink pattern, wherein the sensor further comprises at least one power source that generates a current; and a reader in operative communication with the sensor for detecting a tamper event. In at least a third embodiment, the present technology provides a system for detecting a tamper event in a film comprising at least one stretch film having at least one conductive ink pattern applied thereto that remains conductive when the stretch film is at a percent stretch of about 1% or greater, more preferably from about 1% to about 400%; at least one sensor in operative contact with the conductive ink pattern; at least one reader in operative communication with the sensor for detecting a tamper event; and at least one power source that generates a current through the conductive ink pattern.

Preferred sensors for the practice of the present technology are RFID tags capable of transmitting a signal to an RFID reader. Accordingly, in some embodiments, systems of the present technology for detecting a tamper event in a film comprise at least one stretch film; at least one continuous circuit comprising a conductive ink pattern that is applied to the stretch film; a radio frequency identification tag operatively connected to the continuous circuit, wherein the tag transmits a signal when the continuous circuit is closed and has current running there through; a radio frequency receiver in operative communication with the radio frequency identification tag to detect a tamper event; and at least one power source that generates a current through the continuous circuit comprising the conductive ink pattern.

In yet another aspect, the present technology provides one or more methods of detecting a tamper event in a film or a film package. For example, one embodiment of the present technology provides a method of detecting a tamper event comprising the steps of: (a) providing at least one film having at least one conductive material thereon; (b) applying the film to at least one item; (c) providing at least one sensor in operative connection with the conductive material; (d) completing a closed circuit comprising the conductive material and the sensor; and (e) providing a reader in operative communication with the sensor to detect a tamper event. In another embodiment, the present technology provides a method of detecting a tamper event comprising the steps of providing at least one stretch film having one or more conductive ink patterns that remain conductive when the film is stretched at a percent stretch of about 1% or greater; applying the stretch film to at least one item; providing a radio frequency identification tag that is operatively connected with the conductive ink pattern; completing a closed circuit comprising the conductive ink pattern and the radio frequency identification tag; and providing a radio frequency identification reader in operative communication with the radio frequency identification tag to detect a tamper event.

BRIEF DESCRIPTION OF SEVERAL VIEWS, OF THE DRAWINGS

DETAILED DESCRIPTION OF THE INVENTION

Figure 1:
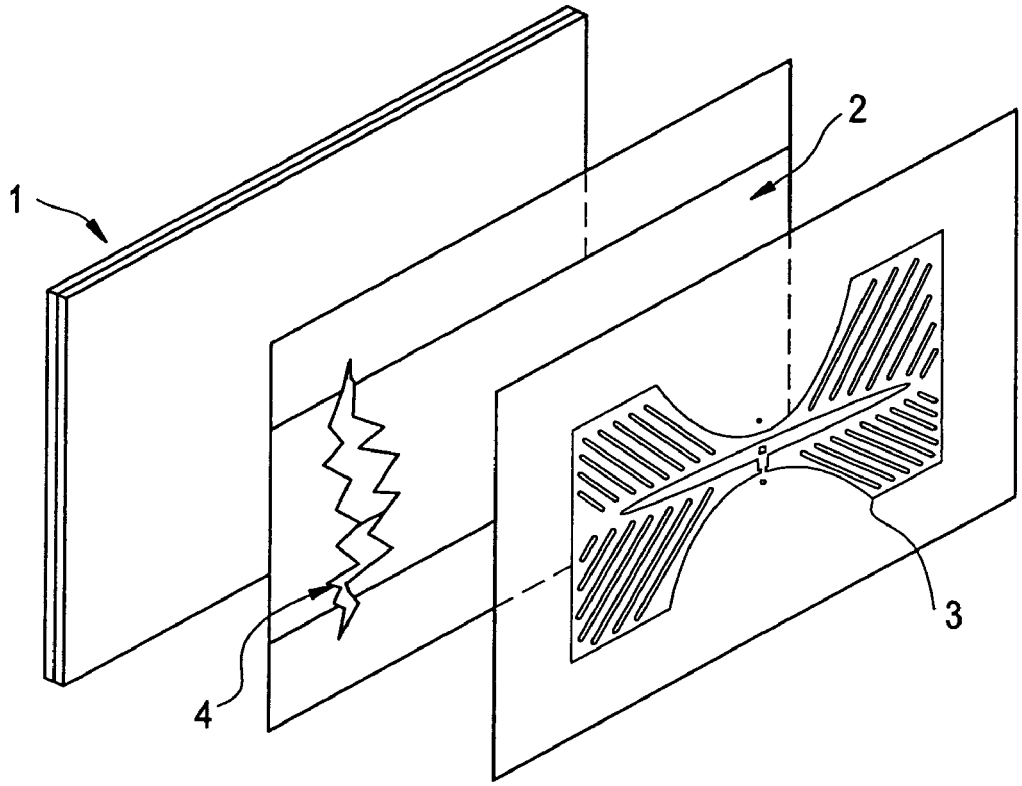
FIG. 1 shows a conceptualization of the elements of one embodiment of the present technology of a system for detecting a tamper event in a film.

The present technology relates to films, systems and methods for detecting a tamper event in a film, film package, or other end use application. The present technology is especially useful in applications for detecting tamper events with bulk packaging or wrapped pallets in circumstances where visual tamper inspection, analysis, and evaluation is hampered or prevented. The present technology is also useful in detecting tamper events with respect to individually packaged or boxed items, and in detecting tamper events with respect to individual packages or boxes within a set of stacked palleted goods. One or more preferred systems, films and methods of the present technology utilize a conductive material and a film to wrap or enclose goods. For example, at least one embodiment utilizes a film, a conductive ink or ink pattern applied to the film, and a sensor in electrical communication with the conductive ink or ink pattern.

At least one preferred embodiment utilizes a stretch film, a conductive ink or ink pattern applied to the stretch film that remains conductive when the film is stretched, and RFID technology to detect a tamper event. Accordingly, tamper evident films of the present technology can be one or more stretch films having at least one conductive ink or ink pattern applied thereto that remains conductive when the films are at various percentages of stretch. In some embodiments, tamper evident films of the present technology can be used such that the conductive ink or ink pattern is operatively connected to at least one RFID tag and at least one power source to form a closed electrical circuit. In other embodiments the RFID tag can include a power source, such that the conductive ink or ink pattern is operatively connected to at least one radio frequency identification tag having at least one power source to form a closed electrical circuit.

In one or more preferred embodiments, RFID technology is employed such that an RFID tag on a film or package of the present technology transmits a signal to an RFID reader when there is a closed electrical circuit to indicate that a tamper event has not occurred. In some preferred embodiments, when a tamper event has occurred, particularly where the tamper event causes the closed circuit to be broken, the RFID tag does not transmit a signal. In other preferred embodiments, when a tamper event has occurred, particularly an event that damages but does not break the circuit, the RFID tag transmits an altered signal. Whether an RFID tag used in conjunction with a tamper evident film of the present technology transmits a signal, an altered signal, or no signal can be determined based upon the strength of the current flowing through a closed circuit comprising the conductive ink pattern, or upon the resistivity of the circuit.

The following discussion of embodiments of the present technology contains references to the Figures included in this disclosure. It should be understood, however, that the present technology is not limited to the embodiments shown in the Figures. Modifications or variations of the embodiments as shown in the Figures are contemplated herein and are encompassed by the present technology.

FIG. 1 shows a conceptualization of the elements of at least one embodiment of the present technology of a system for detecting a tamper event in a film or package. This embodiment comprises a film 1, a conductive ink or ink pattern 2, and an RFID tag (with an antenna) 3. In this figure, there is a break or disruption 4 shown in the conductive ink or ink pattern 2. In preferred embodiments, conductive ink or ink pattern 2 is printed onto or in film 1 in a pattern that is capable of forming at least part of a closed electrical circuit. An RFID tag (with antenna) 3 is attached in operative contact with the ink pattern.

Figure 2:
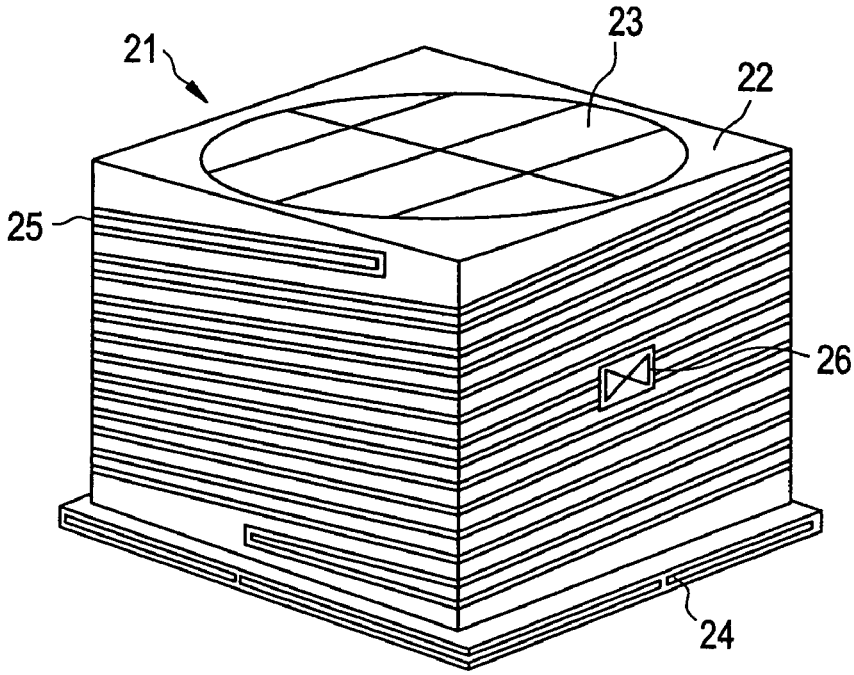
FIG. 2 shows an embodiment of a system of the present technology for detecting a tamper event in a film as used in conjunction with wrapped palleted goods.
Figure 3:
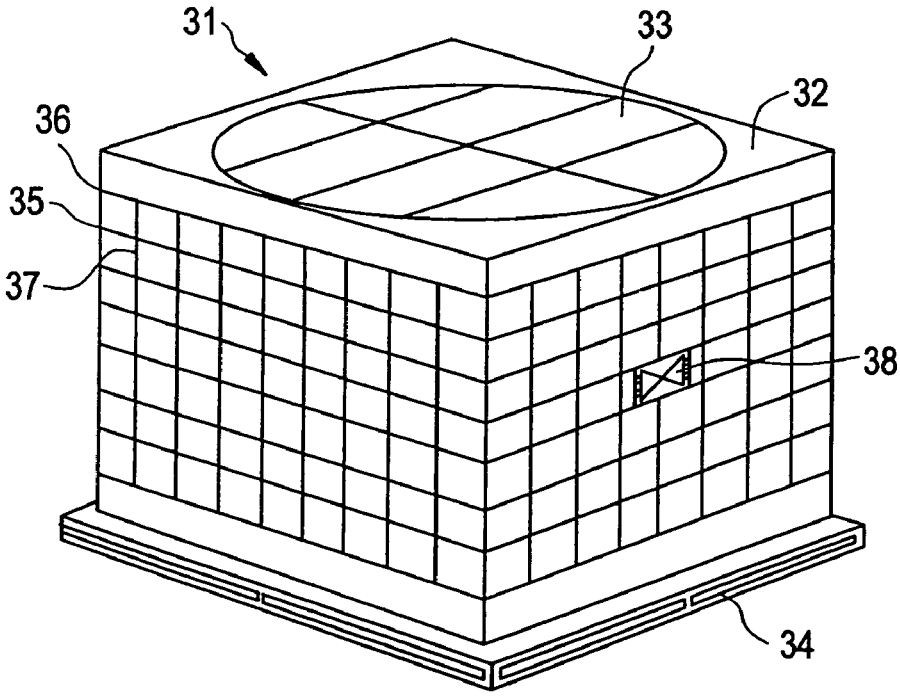
FIG. 3 shows an embodiment of a system of the present technology for detecting a tamper event in a film used in conjunction with wrapped palleted goods.
Figure 4:
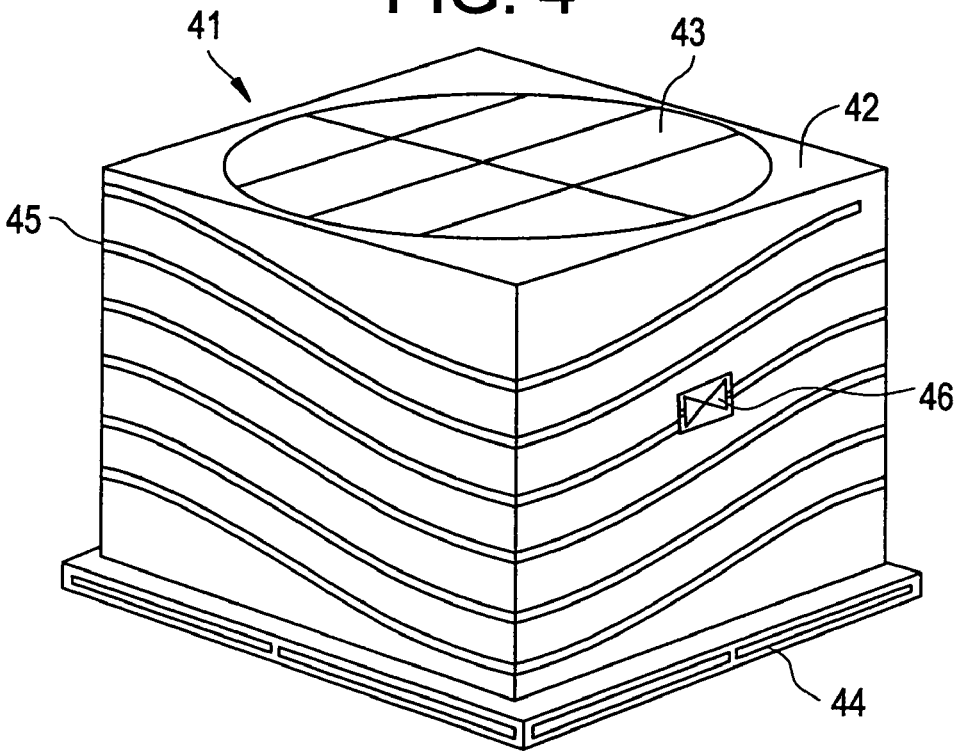
FIG. 4 shows an embodiment of a system of the present technology for detecting a tamper event in a film used in conjunction with wrapped palleted goods.

Two preferred embodiments of systems of the present technology are shown in FIGS. 2, 3, and 4. FIGS. 2, 3, and 4 illustrate wrapped palleted goods 21, 31, and 41 having goods 23, 33, and 43 on pallets 24, 34 and 44, respectively. The palleted goods are wrapped in films 22, 32 and 42 that have conductive ink patterns 25, 35, and 45 applied thereto. Conductive ink patterns 25 and 45 are patterns comprising two continuous substantially parallel traces that wrap around the wrapped palleted goods in a spiral fashion, with conductive ink pattern 25 being substantially straight and conductive ink pattern 45 having a wave in the pattern. Conductive ink pattern 35 is a grid pattern having substantially horizontal trace components 36 and substantially vertical trace components 37. As shown, substantially horizontal trace components 36 are continuous traces that each wrap once around the wrapped palleted goods and intersect substantially vertical trace components 37. In another embodiment of a grid pattern, substantially horizontal trace components 36 could be replaced by a single continuous trace that wraps around the wrapped palleted goods multiple times in a substantially straight or waved spiral fashion, similar to ink patterns 25 or 45, and intersects substantially vertical trace components 37.

It should be understood that there are many conductive ink patterns in addition to those illustrated here that may be used in accordance with the present technology. It is preferred that the conductive ink patterns, such as conductive ink patterns 25, 25 and 45 in FIGS. 2, 3, and 4, cover a substantial portion of the height of the goods, such as the pallet goods illustrated in these particular figures.

Additionally, it is also preferable that the conductive ink or ink pattern be capable of forming or acting as one component in a continuous electrical circuit such that current flows through the conductive ink pattern when the circuit is closed. The conductive ink pattern itself can form a continuous circuit to which a sensor, such as an RFID tag, can be attached (preferably in a conductive manner), or through other means, such as through the use of conductive strips that can be used to connect portions of the ink pattern and thus create a continuous closed circuit. Sensors 26, 38, and 46 in FIGS. 2, 3 and 4 are shown operatively connected to conductive ink patterns 25, 35, and 45, respectively.

Particularly preferred sensors for use with the present technology are RFID tags. Sensors of the present technology preferably complete a closed electrical circuit comprising at least the conductive ink or ink pattern and the sensor. The sensor also preferably incorporates a continuity circuit such that it can detect a tampering event through a change in electrical conductivity/resistivity.

Figure 5:
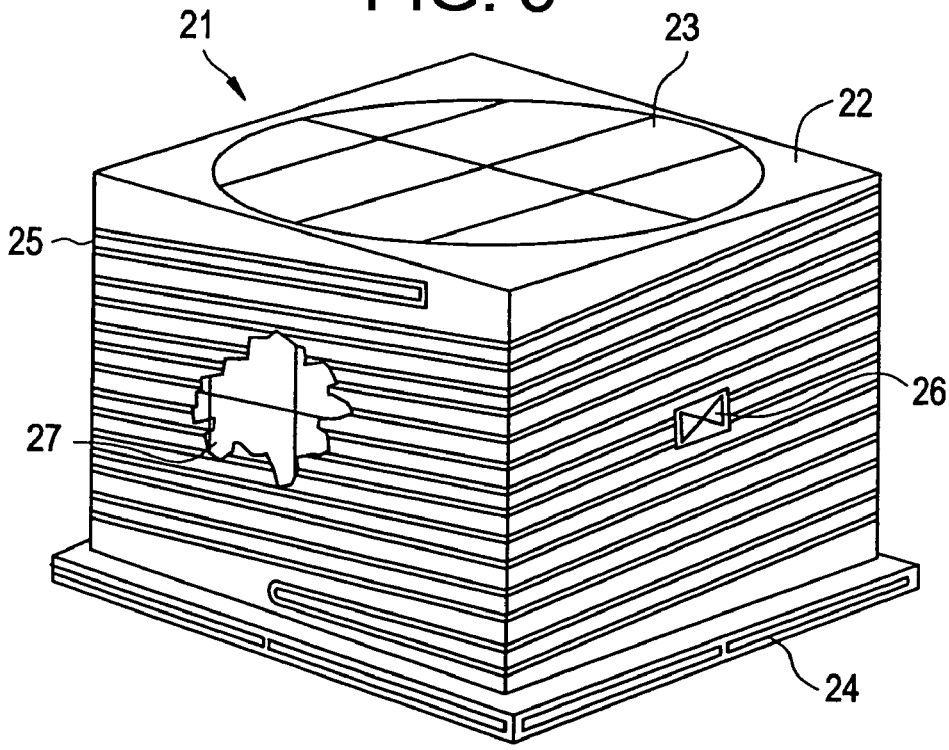
FIG. 5 shows an embodiment of a system of the present technology for detecting a tamper event in a film used in conjunction with wrapped palleted goods having a tamper event or breach present.
Figure 6:
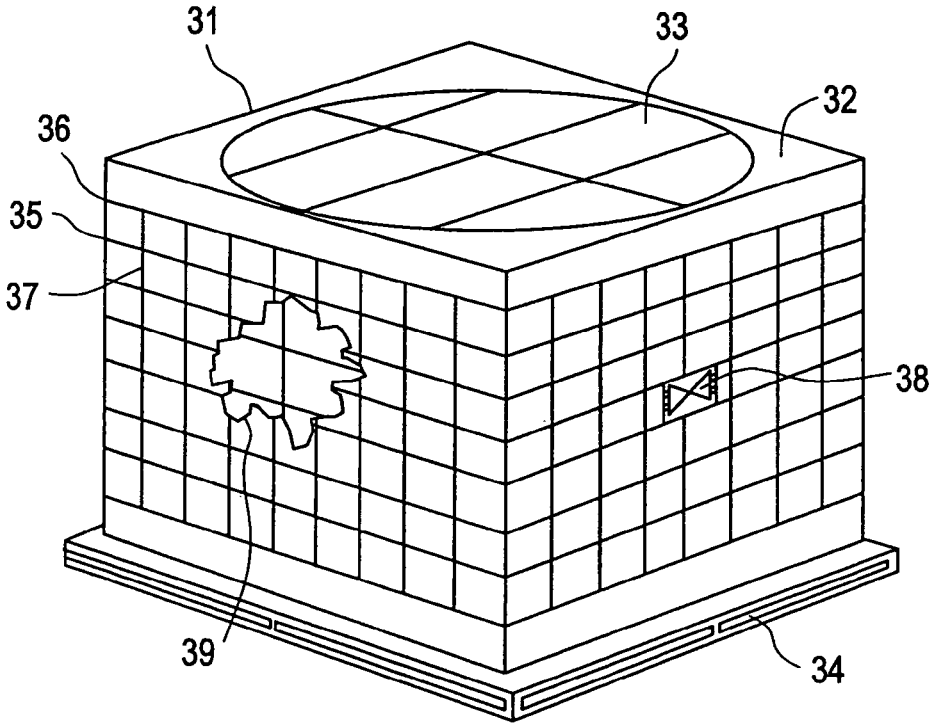
FIG. 6 shows an embodiment of the present technology of a system for detecting a tamper event in a film used in conjunction with wrapped palleted goods having a tamper event or breach present.
Figure 7:
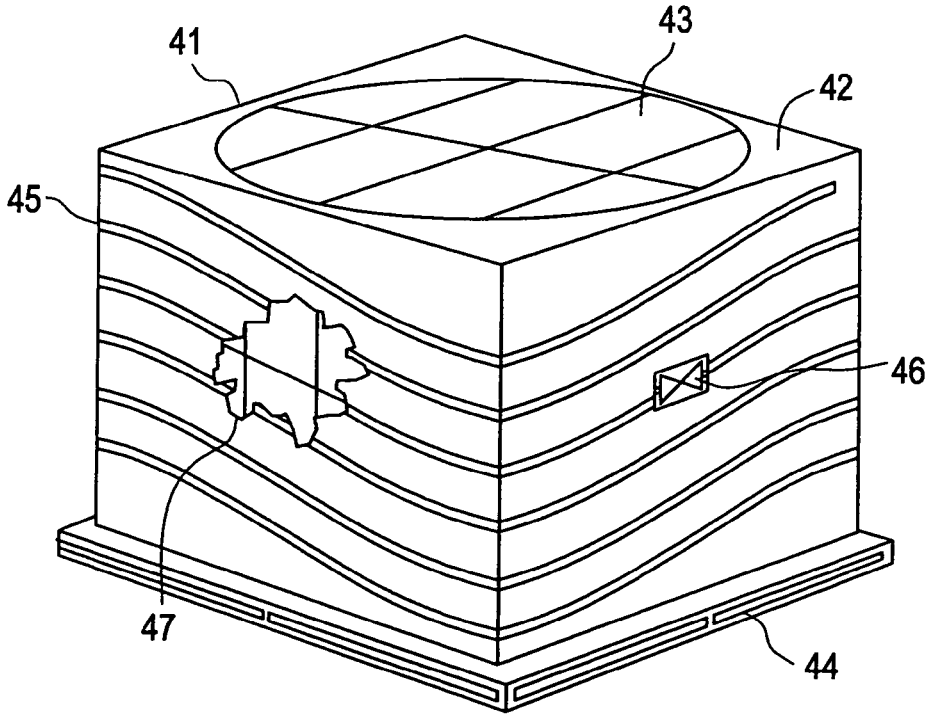
FIG. 7 shows an embodiment of the present technology of a system for detecting a tamper event in a film used in conjunction with wrapped palleted goods having a tamper event or breach present.

FIGS. 5, 6, and 7 illustrate the embodiments shown in FIGS. 2, 3 and 4, respectively, with tamper events 27, 39, and 47 now included. Tamper events 27, 39, and 47 are shown as large holes in films 22, 32, and 42 such that conductive ink patterns 25, 25, and 45 are disrupted. With such a disruption of the conductive ink patterns, the circuits formed by conductive ink patterns and the sensors are broken.

Figure 8:
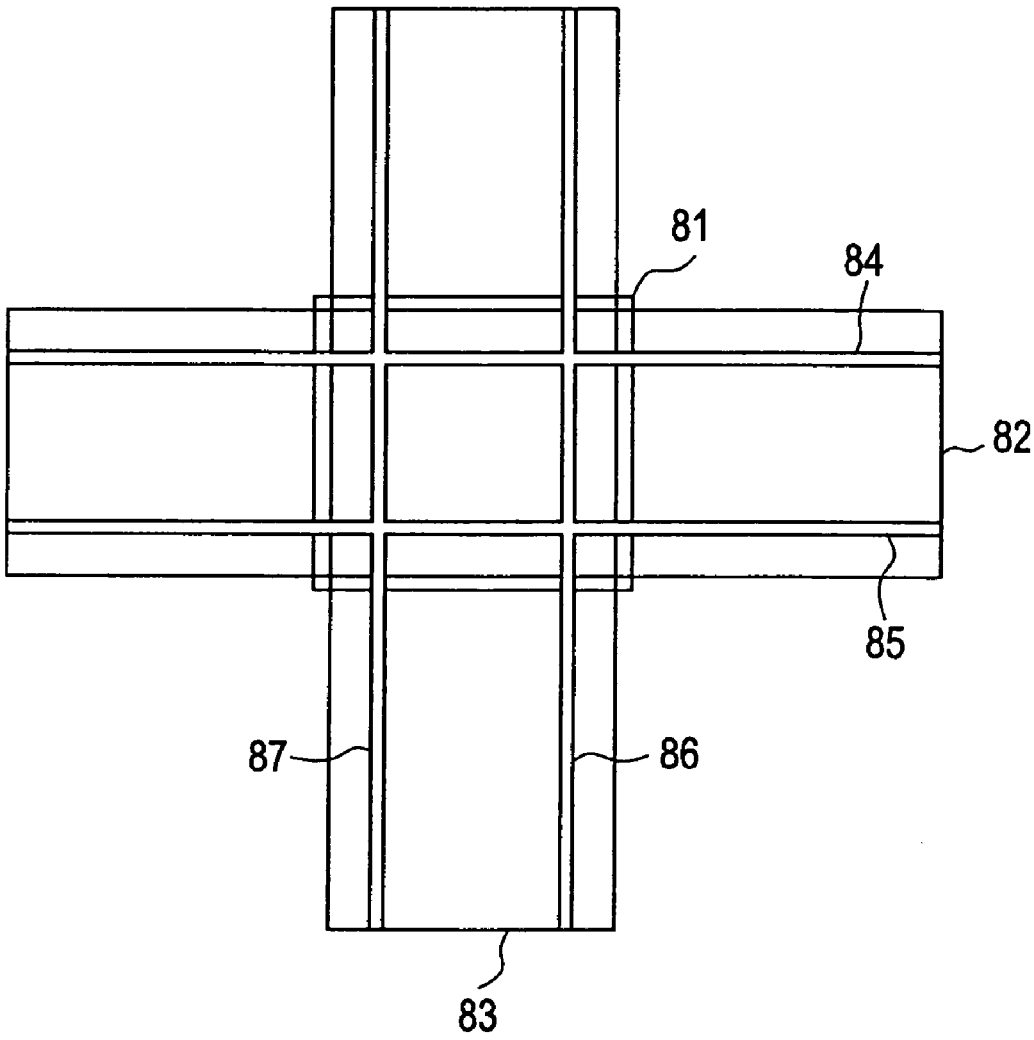
FIG. 8 shows an embodiment of the present technology of a system for detecting a tamper event utilizing sheets of film having at least two lanes of conductive ink thereon.
Figure 9:
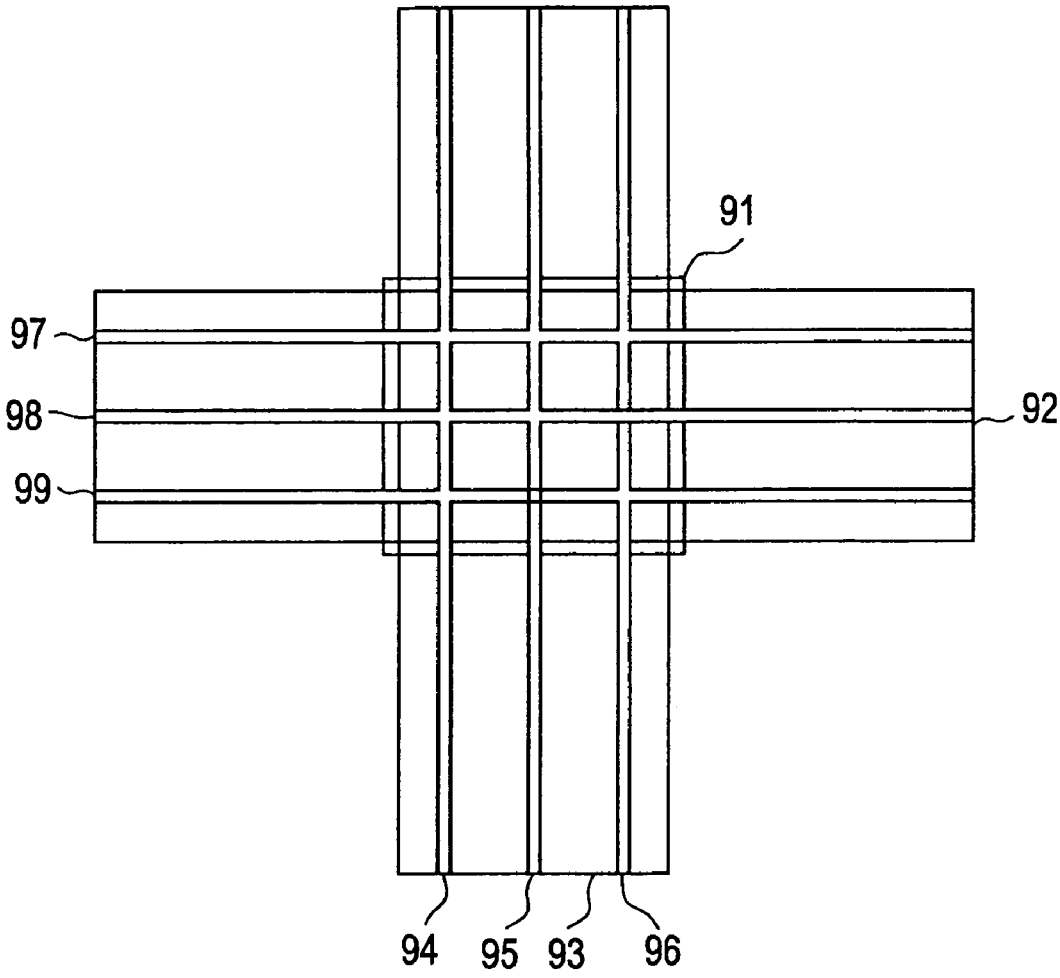
FIG. 9 shows an embodiment of the present technology of a system for detecting a tamper event utilizing sheets of film having at least three lanes of conductive ink thereon.

Two alternative embodiments are illustrated in FIGS. 8 and 9, wherein film with conductive ink is wrapped around palleted goods prior to a stretchhooder being applied. The film with the conductive ink can be draped over the palleted goods. Alternatively, the film with the conductive ink can be laid out, the goods can be stacked over the film, and then the film can be wrapped around the palled goods. In FIG. 8, film sheets 82 and 83 are crossed and draped over palleted goods 81. As illustrated, film sheet 82 has at least two lanes 84 and 85 of conductive ink thereon, and film sheet 83 has at least two lanes 86 and 87 of conductive ink thereon. A conductive band (not shown) can be wrapped around the draped film sheets 82 and 83 to connect a circuit. The conductive band is preferably severed between each of the lanes of conductive ink at each end of the film sheets, to create, for example, a continuous circuit from lane 87 to lane 84 to lane 85 to lane 86 and back to lane 87. A sensor, such as an RFID tag, can, for example, be placed at any point along the conductive band.

In FIG. 9, film sheet 92 has at least three lanes 97, 98 and 99 of conductive ink thereon, and film sheet 93 has at least three lanes 94, 95 and 96 of conductive ink thereon. A conductive band (not shown) can be wrapped around the draped film sheets 92 and 93 to connect a circuit. The conductive band is preferably severed between every other conductive lane, such as between lanes 97 and 98 at one end of sheet 92 and between lanes 98 and 99 at the other end, and between lanes 94 and 95 at one end of sheet 93 and between lanes 95 and 96 at the other end. Severing the conductive band in this manner could create a continuous circuit from lane 94 to lane 95 to lane 96 to lane 97 to lane 98 to lane 99 and back to lane 94. As with the embodiment of FIG. 8, a sensor, such as an RFID tag, can, for example, be placed at any point along the conductive band.

In one or more preferred embodiments, the sensor transmits a signal when there is current flowing through a closed circuit comprising the conductive ink pattern and the sensor. When the closed circuit of the tamper detection system is broken by a gross tamper event, such as those illustrated in FIGS. 5, 6, and 7, current can no longer flow through the circuit. Gross tamper as used herein refers to an event that damages or disassembles the film or film packaging of the present technology on a gross level such that there is no longer a closed circuit comprising the conductive ink pattern. In some embodiments, the sensor does not transmit a signal when there has been a tamper event such that there is not a closed circuit comprising the conductive ink pattern. In these embodiments, large tears, large cuts with razor blades or removal of an object within the wrapped pallet or film package will result in seizure of the sensor when the conductive pattern is disrupted or broken, and the sensor will no longer transmit a signal.

In embodiments of the present technology where sensors operate in only two modes, transmitting a signal when there is a closed circuit and not transmitting a signal when there is not a closed circuit, lesser tamper events will not be detected unless the conductive pattern is severely damaged or interrupted, causing the circuit to be broken. Lesser tamper events include, but are not limited to, punctures with screwdrivers, pens or small sharp objects. These types of tamper events typically would not fully break the closed circuit comprising the conductive ink pattern and the sensor. An example of such an event would be one which results in a cut or break that only partially goes through the conductive ink pattern. In such instances, the strength of the current flow through the circuit would be reduced but not stopped. In other embodiments of the present technology, the sensor transmits an altered signal when there has been a tamper event such that the strength of the current in the conductive ink pattern is reduced, or the resistivity is increased.

In some embodiments, components in addition to a conductive ink pattern and a sensor are used to complete a closed circuit. For example, in instances where the conductive ink pattern itself is not continuous, conductive strips can be placed in contact with the conductive ink to bridge the gap in continuity. Thus, in at least one embodiment of the present technology, completing the closed circuit comprises operatively connecting at least one conductive strip to the conductive ink pattern. Further, a power source is needed in some embodiments, to provide current through the circuit. In some embodiments, then, completing a closed circuit comprises providing at least one power source to generate a current through the circuit comprising at least the conductive ink pattern and the radio frequency identification tag, and possibly also comprising at least one conductive strip.

In one or more preferred tamper detection systems of the present technology, a reader device is used that receives a signal transmitted from the sensor. Readers may be any device capable of receiving the signal transmitted from the sensor. Readers may also transmit signals to the sensor. Preferably, the reader also provides output to the user indicating to the user whether the sensor is transmitting a signal. In preferred embodiments, the reader indicates to the user whether there has been a tamper event based upon whether the sensor is transmitting an altered signal or whether the sensor is not transmitting a signal.

In some embodiments, individual boxes or packages that are a part of a set of palletized goods can be added to a long series circuit so that a tamper event would be indicated if either the exterior wrap or any of the individual boxes or packages were disturbed. For example, palleted goods can be layered on a pallet, and a fragile conductive coating can be applied across the packages or box lids. A circuit from one box or package to the next can be created down a row of boxes or packages to form a conductive trace that can be added to the overall series loop of the pallet. Alternatively, a film sheet with printed conductive traces can be coated with adhesive before the boxes or packages are applied. In such an embodiment, if the boxes or packages are removed, the conductive ink is stripped from the film and the circuit is opened to indicate a tamper event.

Below is a discussion of various acceptable components for use with the present technology. It should be understood that the present technology is not limited by the specific components discussed herein, and that use of variations, alternatives and equivalents of the disclosed components is contemplated.

Films

Films suitable for use as tamper evident films of the present technology can be stretch films, shrink wrap, bagging, stretch hooders, or any other suitable film. Films suitable for use as tamper evident films of the present technology can be monolayer or multilayer films. In at least one preferred embodiment, a tamper evident film is a film having a conductive ink or ink pattern on the film, or in the film if the film is a multilayer film. In at least one particularly preferred embodiment, a tamper evident film is a multilayer film having a conductive ink or ink pattern on or in at least one layer of the film.

The present technology preferably uses stretch films suitable for wrapping and packaging applications. However, it should be noted that any cast or blown monolayer or coextruded films containing one or more materials such as nylons, EVOH, EVA, EMA, PS, olefin based polymers (polymers based on ethylene and propylene), polyolefin based polymers (homopolymers or copolymers made of alkenes, including polyethylenes and polypropylenes), and the like, can be used in tamper evident films and tamper event detection systems of the present technology.

In some embodiments of the present technology, at least one sheet of a film can be applied to a package or set of palleted goods. In one such embodiment, a crossed pair of sheets can be placed on a pallet, the goods can be stacked on top of the sheets, and the sheets can be pulled up toward each other at the top of the pallet. Alternatively, at least one sheet of a film can be draped over the goods from the top down. In such embodiments, the film preferably has a conductive ink or ink pattern applied thereto, and a series loop can be made with a conductive connection around the pallet circumference, preferably at the top or at the base of the palleted goods. Examples of such embodiments are illustrated in FIGS. 8 and 9.

In circumstances such as those illustrated in FIGS. 2-5, stretch film is preferably utilized in the practice of the present technology to wrap or band bulk object(s) for shipping within a supply chain. Wrapping can be accomplished by hand or by use of a machine. The film in these circumstances is loaded under force in one of the most common mechanical stress-strain mechanisms, tension. When a machine is used, the machine used to wrap or band the object(s) actually deforms the material by gradually increasing the tensile load that is applied uniaxially at a constant rate, until a percent stretch or elongation is met that will properly function to contain the bulk object at hand.

In embodiments where the conductive material is separate from the wrapping film, the conductive material can unwind on a different spindle than the film, and the spindle for the conductive material preferably unwinds the material at a speed near the surface speed of the pallet. The film, which is preferably a stretch film, can be applied on the outside of the conductive material to enclose or cover the goods and the conductive material. Conductive material that is separate from the film can include, for example, conductive wires or foil, or conductive polymer sheets or straps. The conductive material can also be a conductive film, such as a carbon black filled film, or a conductively printed film that is not a stretch film. Conductive wires or foil can include, for example, steel, copper, aluminum. etc. In an alternative embodiment, conductive wires or foil can be on a pallet or other base before goods are added, and the conductive wires or foil can be pulled up to cover at least the sides of the pallet and optionally a portion of the top. In another alternative embodiment, conductive wires or foil can be applied from the top of a pallet down. Conductive wires or foil can be applied to goods where the film, such as a shrink wrap or a hooder, is located either on the inside or outside of the conductive wires or foil. Conductive wires or foil can also be fed down a pallet by the fingers of a stretchhooder as it pushes the film down the pallet. Additionally, conductive wires can be epoxy coated so that they do not move with respect to a film.

The output from a wrapping process where a stretch film is utilized in the practice of the present technology to wrap or band bulk object(s) can be seen in a load or force versus elongation graph, such as that shown in FIG. 8. Load and elongation are normalized to the respective mechanical parameters of engineering stress and engineering strain. The engineering stress, σ, is given by the following equation:

$$\sigma = \frac{F}{A_o}$$

where F is the instantaneous load applied perpendicular to the object cross section, usually given in newtons (N) or pounds force ($lb_f$), and $A_o$ is the original cross sectional area before any load is applied ($m^2$ or $in^2$). The subsequent engineering strain, ∈, is defined by the following equation:

$$\varepsilon = \frac{l_i - l_o}{l_o} = \frac{\Delta l}{l_o}$$

where $l_o$ is the initial or original length before any load is applied, and $l_i$ is the instantaneous length of the object under loading. The quantity $l_i - l_o$ is given as the deformation elongation, Δl, or change in length. The strain quantity is a unitless value but is obviously independent of the unit system. Strain can also be expressed as a percentage by multiplying the strain value by 100. The percentage value(s) are used in the classification of stretch films. The percent strain is often referred to as percent stretch when stretch films are being classified because they are equal values and can be utilized interchangeably.

Stretch films suitable for use with the present technology are generally used in applications at a percent stretch of about 1% or greater. Particularly preferred films are capable of reaching up to about 400% stretch without compromising the integrity of the film. In various applications, stretch films of the present technology could be used at percent stretch values such as about 1%, alternatively about 5%, alternatively about 7%, alternatively about 10%, alternatively about 15%, alternatively about 25%, alternatively about 35%, alternatively about 50%, alternatively about 75%, alternatively about 100%, or at values greater than 100% stretch including about 125%, alternatively about 150%, alternatively about 175%, alternatively about 200%, alternatively about 225%, alternatively about 250%, alternatively about 275%, alternatively up to about 300%, alternatively up to about 325%, alternatively up to about 350%, alternatively up to about 375%, alternatively up to about 400%. Preferably, films used in the present technology are used at a percent stretch within the range of from about 1% to about 400% stretch, such as from about 25% stretch to about 200% stretch, from about 50% stretch to about 200% stretch, or from about 75% stretch to about 150% stretch.

In one or more preferred embodiments, tamper evident films, systems and methods of the present technology utilize multilayered coextruded stretch film structures. These stretch film structures preferably comprise from 3 to 5 layers structures comprised of mainly polyolefin polymers. Multilayer stretch films can, however, comprise any number of layers. For example, some multilayer films suitable for use with the present technology comprise 2, 4, 6, 7, or more layers. Suitable films include, but are not limited to, cast or blown extruded and are generally classified either by machine or hand wrap.

Typically, a cast stretch film has an ABC structure, such as that shown in FIG. 9. Preferably, the A and C layers range from about 2% to about 25% of the thickness of the total structure while the core layer ranges from about 50% to about 96% of the thickness of the total structure. One skin layer, A or C, is typically a "cling" layer that is inherently tacky such that when an object is wrapped, the film sticks to itself thus reducing the unraveling tendency of the stretch film while maintaining the proper load or compression force on the object during shipping or storage. In a preferred embodiment, the inherent tackiness is provided by ultra low density polyethylene materials.

The following table provides examples of materials that can be used in forming films suitable for use with the present technology:

| Film Type | Layer | Resins |
|---|---|---|
| Machine | Cast Core | LLDPE (0.8-4 MI), LDPE |
| | Cast Cling | ULDPE, Plastomer, LLDPE |
| | Cast Non-Cling | LLDPE, PP |
| | Blown | LLDPE (0.8-1 MI), LDPE |
| Hand | Cast Core | LLDPE (0.5-1 MI), LDPE |
| | Cast Cling | ULDPE, Plastomer, LLDPE |
| | Cast Non-Cling | LLDPE |
| | Blown | LLDPE (0.5-1 MI), LDPE |

In the above table, MI stands for melt index, LLDPE stands for linear low density polyethylene, ULDPE stands for ultra low density polyethylene, LDPE stands for low density polyethylene, PP stands for polypropylene, and the word plastomer encompasses all copolymeric materials containing the propylene-ethylene union that are specifically designed to process well while still maintaining excellent mechanical properties and optics suited for the demanding stretch film applications.

Some commercially available examples of hand wrap and machine wrap films suitable for use with the present technology are available form Pliant Corporation under the trade names: R122, Classic, Micron, EZM, OPTX, HXF-575, HXF-214, R410, WinWrap, EZH, and HXF-407.

Conductive Ink

The present technology preferably utilizes a conductive ink on or in a film or film layer. In preferred embodiments the conductive ink is applied to a film in a conductive ink pattern. As used herein the term "applied thereto" means that the conductive ink or ink pattern may be applied in any manner such that the ink is disposed on or in a monolayer film; or on, in or between one or more layers of a multilayer film. For example, the conductive ink or ink pattern can be applied onto the surface of a film, within a layer of a film, and between layers of a film.

Methods of applying the conductive ink or ink pattern to the stretch films of the present technology can include, without limitation, all forms of printing (e.g., gravure printing), injection, photonic curing, etc. Preferably, the conductive ink or ink pattern is applied to the stretch film via a photonically cured process such as that commercially offered by NovaCentrix Corporation (Austin, Tex.), and further described in published PCT Patent Application Nos. WO2003106094, WO2005031974, WO2005080042, and WO2006,071419, the disclosures of which are herein incorporated by reference in their entirety.

As discussed above, films suitable for use as tamper evident films can be monolayer or multilayer films. In some embodiments, ink is applied onto or into a monolayer film. In other embodiments, ink is applied onto or into a layer of a film that is then formed into a multilayer film via laminate or coextrusion processes. In at least one preferred embodiment, the tamper evident film is a multilayer stretch film, and the conductive ink is applied on at least one layer of the film, or in at least one layer of the film. In embodiments where the ink is on at least one layer of a multilayer film, the conductive ink can be on the outer surface of the film, or can be between at least two layers of the film.

As is evident from the embodiments discussed herein, conductive ink, or conductive ink patterns can be on the surface of a film, or can be incorporated into a film (either within a single layer or between layers). When a conductive ink is located within a single film layer or between two layers of film, concerns regarding oxidation tend to be alleviated, which allows the use of conductive inks comprising metals such as copper or aluminum. When a conductive ink pattern is incorporated into a film, however, measures will need to be taken to expose certain areas of the conductive ink pattern so that a closed circuit comprising the conductive ink pattern and the sensor can be formed.

In particularly preferred embodiments, the conductive ink forms a conductive ink pattern comprising at least one continuous trace. The term trace refers to at least one line or trail of conductive ink on or within a film. A continuous trace of conductive ink preferably forms one component of a closed circuit through which current flows during operation of a tamper detection system using a tamper evident film. Accordingly, it is preferred that conductive ink traces of the present technology form solid, or substantially unbroken, lines or trails, such that current can flow through or along the trace. In preferred embodiments, the conductive ink pattern is continuous and capable of forming or being a component of a closed circuit. Preferred continuous conductive ink patterns include, for example, patterns comprising at least one substantially continuous trace, at least two substantially parallel continuous traces, grid patterns, curved patterns, wave patterns, zigzag patterns, figure eight patterns.

In one or more embodiments of the present technology utilizing stretch films, suitable conductive materials can be applied prior to or after elongation of the stretch film. When conductive materials are applied after elongation of a stretch film, such conductive materials can include, for example, a conductive ink or conductive epoxy. When conductive ink patterns are applied prior to elongation, suitable conductive ink patterns should be specifically tailored to adhere and coat the stretch film structures while still maintaining functionality such as conductivity after the film is stretched during the palletizing process. The conductive inks are preferably formulated with proper binders to increase the adherence and integrity of the conductive pattern. In preferred embodiments, a conductive ink pattern remains conductive and is still capable of forming a closed circuit at percent stretch values such as about 1%, alternatively about 5%, alternatively about 7%, alternatively about 10%, alternatively about 15%, alternatively about 25%, alternatively about 35%, alternatively about 50%, alternatively about 75%, alternatively about 100%, or at values greater than 100% stretch including about 125%, alternatively about 150%, alternatively about 175%, alternatively about 200%, alternatively about 225%, alternatively about 250%, alternatively about 275%, alternatively up to about 300%, alternatively up to about 325%, alternatively up to about 350%, alternatively up to about 375%, alternatively up to about 400%. Preferably, conductive ink and conductive ink patterns of the present technology remain conductive at percent stretch values within ranges of from about 1% to about 400% stretch, such as from about 25% stretch to about 200% stretch, from about 50% stretch to about 200% stretch, or from about 75% stretch to about 150% stretch.

Conductive ink patterns can be applied to films in several ways. Formulations of conductive ink should be specifically designed or tailored to the particular process by which the ink is being applied. In a particularly preferred embodiment, the ink system used to form the conductive ink pattern is comprised of nano-sized silver (Ag) particles, binders, and organic solvents. The silver particle content of the ink is preferably between about 20% to about 25%. Some examples of conductive inks suitable for use in the present technology have been developed by Nanotechnologies, Incorporated (d.b.a. NovaCentrix) in Austin, Tex., and are sold under the Tradenames METALON™ JS-011 and METALON™ FS-066. Descriptions of inks developed by Nanotechnologies, Inc. that may be suitable for use with the present technology can be found, for example, in published PCT Application No. 2006071419. In other embodiments, particles of other conductive metals can be used, including but not limited to copper, gold, platinum, aluminum, and nickel.

In a preferred embodiment, a conductive ink pattern is deposited onto a stretch film structure(s) by way of a dual spray head system that pulses or periodically sprays ink directly onto the surface of the film at different speeds depending on the line speed of the machine. The pulsing automatically adjusts to the speed of the line. The preferred application speed of the line is from about 10 ft/min to about 200 ft/min.

In other embodiments, a conductive ink pattern is deposited onto a stretch film structure(s) by way of a flexographic or gravure printing processes. The flexographic or gravure process allows printing at faster speeds than the dual spray system while producing a cleaner, more efficient conductive trace on the film surface.

The conductive ink pattern is preferably printed onto the film and subsequently cured. Various curing processes can be used with the present technology, including, but not limited to, photonic curing, solvent based curing, water based curing, plasma curing, and radiation curing (e.g., ultraviolet, electron beam, etc.). In selecting a curing method for use with the present technology, it should be kept in mind that the curing should not adversely affect the film to which the conductive ink has been applied, such as by distorting the structure of the film. For example, the temperature at which curing takes place should be below the melting temperature of the film. Preferably, curing should take place at temperatures at or near temperatures that films are normally subjected to when used in bulk wrapping and packaging applications, such as room temperature. In some embodiments, conductive ink is cured on a stretch film at a temperature of between about 15° C. to about 30° C., preferably at a temperature of between about 20° C. to about 28° C.

A particularly preferred curing method is photonic curing. Some photonic curing methods suitable for use with the present technology have been developed by Nanotechnologies, Incorporated (d.b.a. NovaCentrix) (Austin, Tex.), and are described, for example, in published PCT Patent Application Nos. WO2003106094, WO2005031974, WO2005080042, and WO2006,071419, the disclosures of which are herein incorporated by reference in their entirety. Preferred photonic curing methods provide room temperature curing that utilizes intense flashes of energy (light) to sinter the nano-sized particles within the ink system thus increasing the conductivity of the printed pattern while not having an adverse affect on the substrate to which it has been applied. In some embodiments, conductive ink is photonically cured on a stretch film at a temperature of between about 15° C. to about 30° C., preferably at a temperature of between about 20° C. to about 28° C.

Tamper Evident Films

Embodiments of tamper evident films of the present technology combine the film and conductive ink technologies discussed above to provide films having a conductive ink or ink pattern applied thereto. Tamper evident films of the present technology can be monolayer or multilayer films having conductive ink applied to at least one layer of the film.

In some embodiments, tamper evident films of the present technology are used in bulk packaging or shipping applications. In some preferred embodiments, tamper evident films of the present technology are used to wrap goods on a pallet. In such embodiments, the tamper evident film is preferably a stretch film having a conductive ink applied thereto that remains conductive when the film is at a percent stretch of about 1% or greater.

The conductive ink can be applied in any manner suitable for the end use application. For example, the stretch film can be a multilayer stretch film and the conductive ink is applied on at least one layer of the film, between at least two layers of the film, or in the stretch film. In preferred embodiments, the conductive ink forms a conductive ink pattern on or in the stretch film comprising at least one continuous trace. Preferred conductive ink patterns are any patterns suitable for acting as part of a closed circuit. Examples of preferred conductive ink patterns include, for example, patterns comprising at least two substantially parallel continuous traces such as those shown in FIGS. 2 and 4, and grid patterns such as the one shown in FIG. 3.

Tamper evident films of the present technology are preferably utilized such that the conductive ink or ink pattern applied thereto is operatively connected to at least one sensor, and a closed circuit is formed comprising the sensor and the conductive ink pattern. Preferred sensors are RFID tags, and can be active, passive or semi-passive. Accordingly, a power source to generate a current through the circuit can be provided separately from the sensor, or can be incorporated as part of the sensor. Thus, in one embodiment, a tamper evident film is provided wherein the conductive ink pattern is operatively connected to at least one radio frequency identification tag and at least one power source to form a closed circuit. In another embodiment, a tamper evident film is provided wherein the conductive ink pattern is operatively connected to at least one radio frequency identification tag having at least one power source to form a closed circuit. Sensor technology suitable for use with the present technology is discussed in more detail below.

Sensors

Sensors are used in embodiments of the present technology as components of a closed electrical circuit that also includes a conductive material such as conductive wires or foil, or a conductive ink on a tamper evident film. In such embodiments, a sensor is preferably operatively connected to the conductive material, and the sensor transmits a signal when there is current flowing through the closed electrical circuit comprising the ink or ink pattern and the sensor. As discussed above, in some embodiments the sensor does not transmit a signal when there has been a tamper event that breaks the circuit, such as by breaking the conductive ink pattern. In certain embodiments, the sensor transmits an altered signal when there is a tamper event that reduced the current flow through the circuit but does not break the circuit.

Sensors can include any device or mechanism that is capable of indicating the occurrence of a tamper event. For example, an alarm circuit where a light, buzzer or even an e-paper message could be utilized to indicate whether a package has been tampered with.

Preferred sensors comprise radio frequency identification (RFID) tags. RFID technology has been used in many areas for the storage and retrieval of information regarding an object on which an RFID tag has been placed. RFID technology enables data to be transmitted by a mobile device, called a tag, which is read by an RFID reader and processed according to the needs of a particular application. The data stored and transmitted by RFID tags often provides identification or location information, or other specifics about the product tagged, such as price, color, or date of purchase. RFID technology can be used in areas that formerly required barcodes or magnetic strips. For example, RFID technology can be used commercially in pallet and shipping container identification and tracking. However, there are difficulties in utilizing RFID technology to effectively and efficiently indicate tamper events, especially in conjunction with substrates such as films used in the packaging and shipping industries. The present technology provides some films, systems and methods that overcome those difficulties.

In embodiments where RFID is employed, it is preferred that an RFID sensor be utilized in conjunction with other sensors such as temperature, humidity, shock or strain so that other useful information about the package or pallet content conditions can be conveyed.

In general, RFID tags contain silicon chips and antennas to enable receipt of radio-frequency queries from an RFID reader, and transmission of radio-frequency information to the RFID reader. One type of RFID tag is known as a passive tag, which does not have an internal power supply. With passive tags, the minute electrical current induced in the antenna by an incoming radio frequency signal provides the power for the integrated circuit embedded within the tag to power up and transmit a response. Another type of RFID tag is known as a semi-passive RFID tag. Semi-passive RFID tags are very similar to passive tags except for the inclusion of a small battery which allows the integrated circuit of the semi-passive tags to be constantly powered and removes the need for the antenna to be designed to collect power from the incoming signal. A third type of RFID tag is known as an active tag. Active RFID tags have their own internal power source which is used to power any integrated circuits contained therein to generate the outgoing signal. Active tags are typically more reliable (e.g., experience fewer errors) than passive type tags. Further, active tags, due to their onboard power supply, also transmit at higher power levels than passive tags, allowing them to be more effective in radio frequency signal challenged environments like water (including humans/cattle, which are mostly water), heavy metal (shipping containers, vehicles), or over long distances.

RFID tags suitable for use with the present technology can be passive, semi-passive, or active. Accordingly, power sources used to generate current through a closed circuit comprising an RFID tag and a conductive ink pattern applied to a film can be separate from the RFID tag, or the RFID tag can comprises a power source that generates a current.

Preferred sensors further comprise continuity testing circuits, or resistivity testing circuits. In one preferred embodiment, an RFID tag is used that can detect a change in electrical conductivity by implementing a continuity tester and a series of switches. In this embodiment, when the conductivity of the circuit to which the RFID tag is attached is broken, the tag does not transmit a signal, and thus will not respond to the reader. In a similar embodiment, in addition to not transmitting when the circuit is broken, the tag also does not transmit when the resistivity is greater than a certain predetermined amount, such as 10 MΩ (mega-ohms), for example.

In some embodiments, a continuity testing circuit is incorporated into the RFID tag between the RFID tag microprocessor and the RFID antenna. In at least one such embodiment, voltage reference circuits power RF switches and keep them closed so that the microprocessor stays connected to the antenna when current is applied to the closed circuit. When the circuit is closed, the RFID is thus able to transmit a signal. If the circuit is broken, however, the voltage reference circuit shuts off. Therefore, the RF switches lose the control signal and open. With the RF switches open the RFID tag microprocessor is disconnected from the RFID antenna, and the tag is unable to respond to the RFID reader.

RFID technology suitable for use with the present technology is available from a number of sources, including, but not limited to: Nanotechnologies, Inc. (d.b.a NovaCentrix Corp), IBM Global Services, Intermec, Texas Instruments, SAVI Technology, Alien Technology, Symbol Technologies, Honeywell, Checkpoint, Impinj, Avery Dennison, Webra, Omron, Laudis Systems, Tagsys RFID, Oracle, Power-ID, and SATO.

Tamper Evident Systems

Some embodiments of the present technology provide systems for detecting tamper events in films and packages. Such systems combine the technologies described above to provide systems that indicate whether tamper events have occurred. For example, in one embodiment, the present technology provides a system for detecting a tamper event in a film comprising a stretch film having a conductive ink pattern applied thereto that remains conductive when the stretch film is at a percent stretch of about 1% or greater, more preferably from about 1% to about 400%, a sensor in operative contact with the conductive ink pattern, wherein the sensor further comprises a power source that generates a current, and a reader in operative communication with the sensor for detecting a tamper event. In another embodiment, the present technology provides a system for detecting a tamper event in a film comprising a stretch film having a conductive ink pattern applied thereto that remains conductive when the stretch film is at a percent stretch of about 1% or greater, more preferably from about 1% to about 400%, a sensor in operative contact with the conductive ink pattern, a reader in operative communication with the sensor for detecting a tamper event, and a power source that generates a current through the conductive ink pattern.

In preferred embodiments, stretch films utilized in a tamper detection systems are multilayer films, and more preferably each layer of such a multilayer stretch film comprises polyolefin.

Tamper detection systems of the present technology preferably operate in a manner that indicates a tamper event by whether the sensor incorporated therein transmits a signal when there is a closed circuit comprising the conductive ink in/on the tamper evident film and the sensor. For example, in one embodiment, the sensor does not transmit a signal when the closed circuit comprising the conductive ink pattern is broken. In another embodiment, the sensor transmits an altered signal when the strength of the current through the conductive ink pattern is reduced. In some embodiments the sensor transmits an altered signal, or does not transmit a signal, when the resistance of the closed circuit comprising the conductive ink pattern is increased.

In one preferred embodiment, the sensor does not transmit a signal when the resistance of the closed circuit comprising the conductive ink pattern is greater than about 10 megaohms. Tampering can also be detected through the utilization of other electric parameters. For example, if the conductive material is folded over with a dielectric material between it, a capacitor can be created, and a circuit can be created which can detect a change in capacitance as an indicator of tampering. A film which has a conductive ink printed on it can serve as the dielectric if the film is folded to put unprinted surface to unprinted surface with two lanes of printed ink serving as parallel plates. In another embodiment, the inductance of a circuit can be measured. For example, a conductive material can be wrapped around a package or pallet in a spiral coil, which would have appreciable inductance properties. Inductive coupling could be used to power a circuit if it was "interrogated" with an inductive field. Each electric parameter, whether resistance, capacitance, or inductance, could be detected by a circuit on board the package or pallet. Similarly, each parameter can be communicated by RFID, or can be referenced by computer with an initial value that was measured during shipment.

Preferred sensors for use with the present technology are RFID tags capable of transmitting a signal to an RFID reader. Accordingly, in some embodiments, systems of the present technology for detecting a tamper event in a film comprise a stretch film, a continuous circuit comprising a conductive ink pattern that is applied to the stretch film, a radio frequency identification tag in operative contact with the continuous circuit, wherein the tag transmits a signal when the continuous circuit is closed and has current running therethrough, a radio frequency receiver in operative communication with the radio frequency identification tag to detect a tamper event, and a power source that generates a current through the continuous circuit comprising the conductive ink pattern.

Methods

There are several methods by which a tamper detection system can be incorporated into shipping and packaging applications. For example, one embodiment of the present technology provides a method of detecting a tamper event comprising the steps of providing at least one stretch film having one or more conductive ink patterns that remain conductive when the film is stretched at a percent stretch of about 1% or greater; applying the stretch film to at least one item; providing a radio frequency identification tag that is operatively connected with the conductive ink pattern; completing a closed circuit comprising the conductive ink pattern and the radio frequency identification tag; and providing a radio frequency identification reader in operative communication with the radio frequency identification tag to detect a tamper event. The step of completing the closed circuit can include operatively connecting at least one conductive strip to the conductive ink pattern. The step of completing the closed circuit can alternatively, or additionally, include the step of providing a power source to generate a current through the circuit comprising the conductive ink pattern and the radio frequency identification tag.

RFID tags used in methods of the present technology can be provided in any manner that is suitable to the particular application. For example, an RFID tag can be affixed to the conductive ink pattern such that they are in conductive contact after the film has been wrapped around the goods. Alternatively, an RFID tag can be incorporated into or onto the film, such that it is in conductive contact with the ink pattern, during the tamper evident film making process, or can be otherwise affixed in conductive contact with the conductive ink pattern prior to the film being used to wrap goods.

In at least one embodiment of the present technology, stretch film printed with a conductive ink pattern can be used in conjunction with a stretch wrapping machine for the palletizing process. Unstretched pre-printed stretch wrapping material can be utilized to unitize the pallet. In such an embodiment, the conductive ink pattern can contain a specified pattern of flexible, photonically cured ink. The conductive ink pattern can be formed so that the ink pattern itself is capable of forming a continuous closed loop. In other embodiments, the conductive ink pattern may not form a continuous closed loop without the addition of other elements, such as a conductive strip.

In an embodiment that includes the application of a conductive strip to form a continuous closed loop, the palletizing process may be stopped once it has begun in order to allow the conductive strip to be attached. In this embodiment, the wrapping would then continue after the conductive strip is attached. Once the wrapping has caused the conductive ink pattern to reach the middle or top of the pallet, the wrapping machine can again be stopped to allow an RFID tag to be attached in contact with the conductive ink pattern. If the wrapping machine has been stopped before the wrapping process is complete, it should then be stared again until wrapping is finished.

Once wrapping process is complete, the RFID enabled pallet/bulk package should be scanned with an RFID reader to ensure proper data transmission from the RFID tag. If the RFID tag properly receives and transmits the data that has been commissioned to it, the tamper event detection system is in place and ready for operation.

In the following examples, all measured amounts are approximations, unless indicated otherwise. One skilled in the art will recognize that modifications may be made without deviating from the spirit or scope of the present technology. The experiments described in the following examples, and the devices tested therein, are not to be construed as limiting the invention or scope of the specific procedures or devices described herein.

EXAMPLES

Film Behavior Under Loading

Stretched films experience stress relaxation, or an increase in strain, with constant load applied over time. This idea for polymers is described as viscoelastic creep, where the force or applied load remains constant throughout the experiment and the material (stretched film) continues to stretch or relax over time without the addition of heat as seen in some metallurgical applications.

Testing was done regarding film behavior under loading to assist in gaining an understanding of the viscoelastic creep of films as reflected by compression and tension values over time. It is believed that knowledge of film behavior under loading can be used in the design and programming of tamper event detection systems to be used in shipping and packaging applications such as those discussed herein.

The compression loads of three stretch films commercially available from Pliant Corporation, in Schaumberg, Ill., were studied. The films are sold under the trade names Micron, Classic, and R122. The thickness of each film tested was 0.6 mil, and the film samples were each about 20 inches long in the cross-direction.

Testing was done using a Lantech on-pallet machine. The Lantech stretch wrapper is a turntable model that is used for general purpose wrapping of pallets or loads. This machine is simply hand-loaded with a stretch wrap of choice and can be automatically engaged to completely cover four sides of the load at hand, by horizontally wrapping (direction of force applied) the object while moving vertically upwards and downwards. This type of machine is used in a semi-automatic environment where loading and unloading of the pallet or object at hand is done by fork truck or pallet jack. This machine can be outfitted with a cylindrical drum, which we have done for experimentation, to measure the film behavior during and after the stretch wrapping process. The machine can also be outfitted with compression load cells to measure film performance during the stretch wrapping process.

Figure 10:
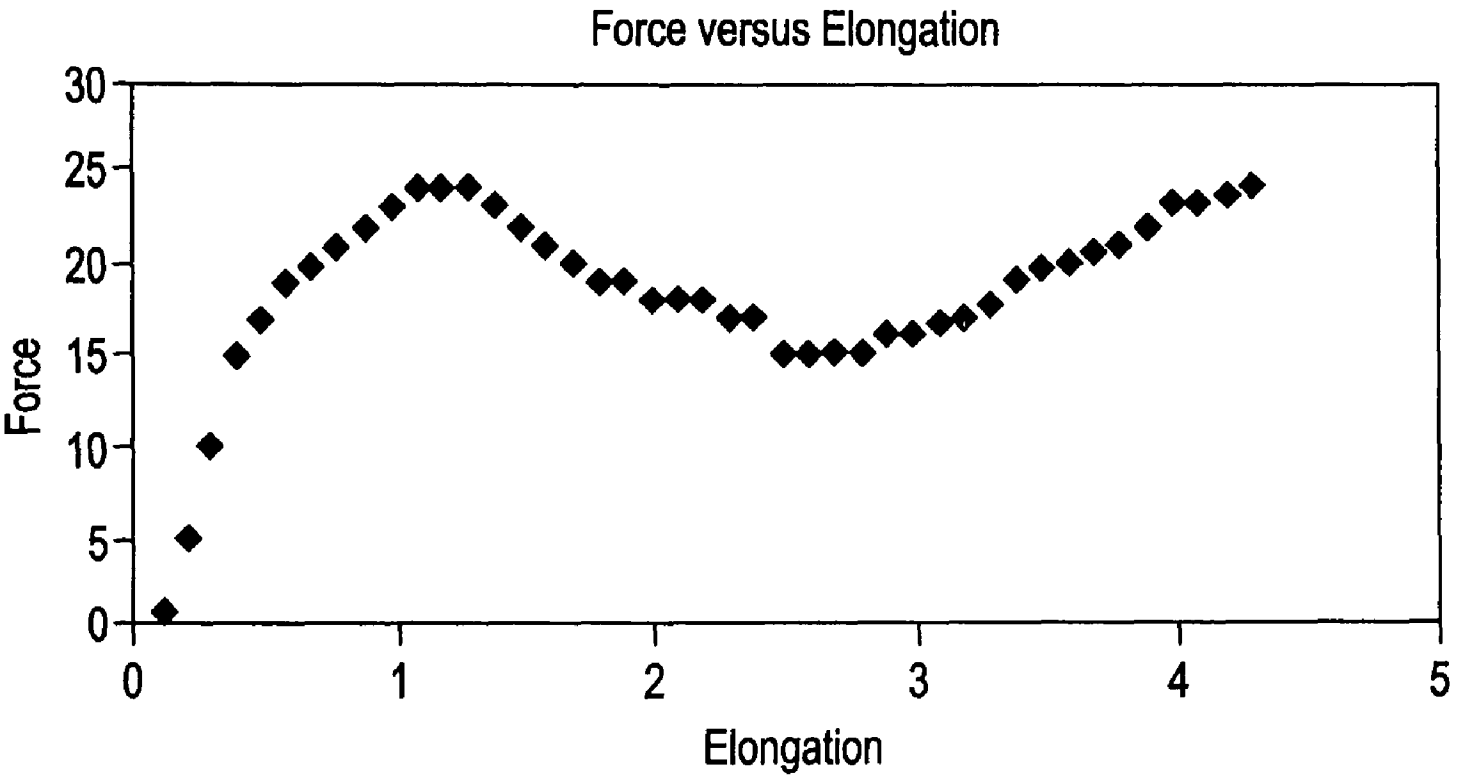
FIG. 10 shows a plot of the output from a wrapping process as a function of force (load) versus elongation.

The Lantech's initial film pre-stretch was set to 250% and 14 lb for a secondary force as the film was loaded onto a 48 inch drum. FIG. 10 is a schematic of the drum and the position of the compression load cell. Each film was wrapped three times around the drum and then an initial compression value was recorded. Compression values were recorded every 15 seconds for the first 4 minutes of the relaxation and then at 1.5 hours. The compression values were then plotted versus the relaxation time.

Figure 11:
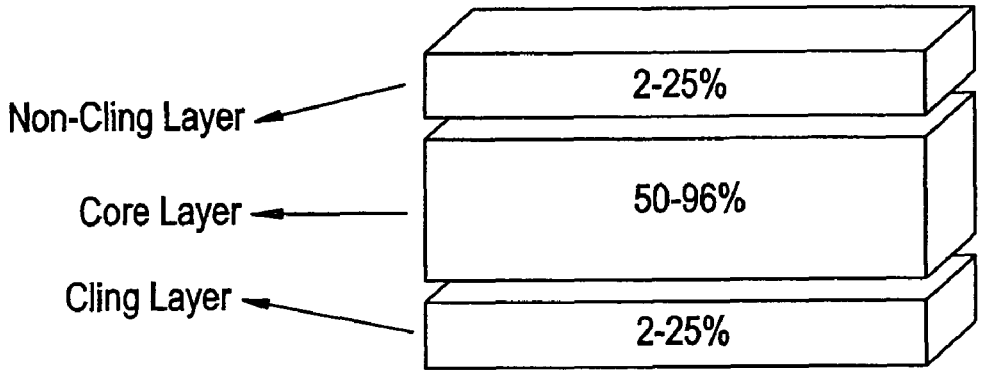
FIG. 11 shows a three layer film of the present technology having an ABC structure including a non-cling layer, a core layer, and a cling layer.
Figure 12:
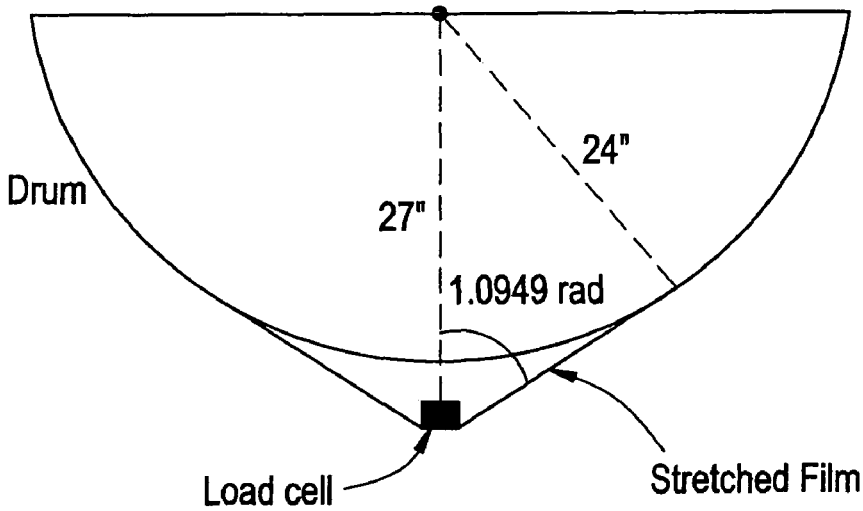
FIG. 12 is a schematic showing how a film of the present technology wraps a compression load cell extended 3 inches from the surface of a drum.

FIG. 11 displays the plots for all three film samples showing compression load versus log t (sec) which results in a linear relation. FIG. 12 displays the plots for all three film samples showing how the compression load decreases in real time.

Figure 13:
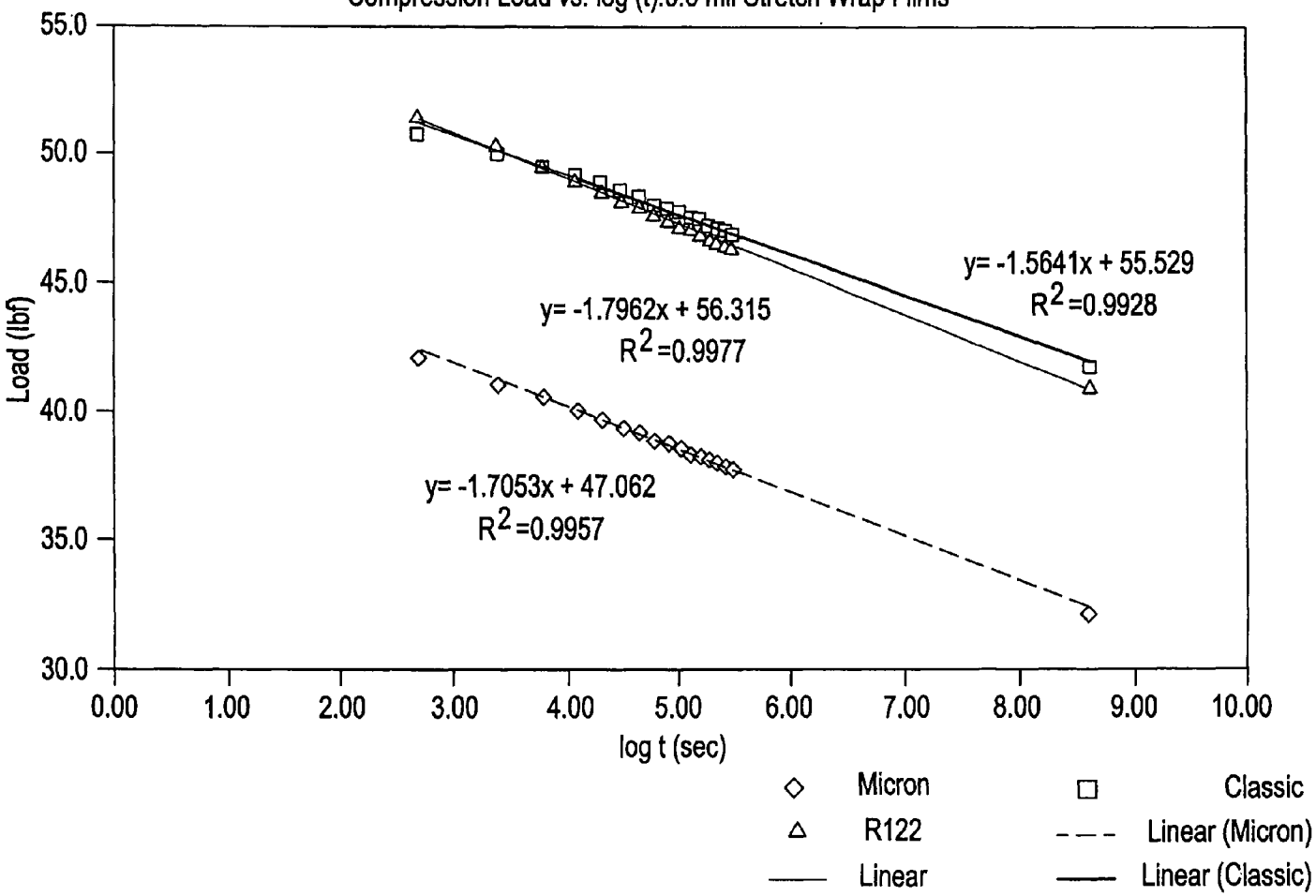
FIG. 13 shows a plot of compression load versus log t (sec) for three 0.6 mil stretch wrap films of the present technology.
Figure 14:
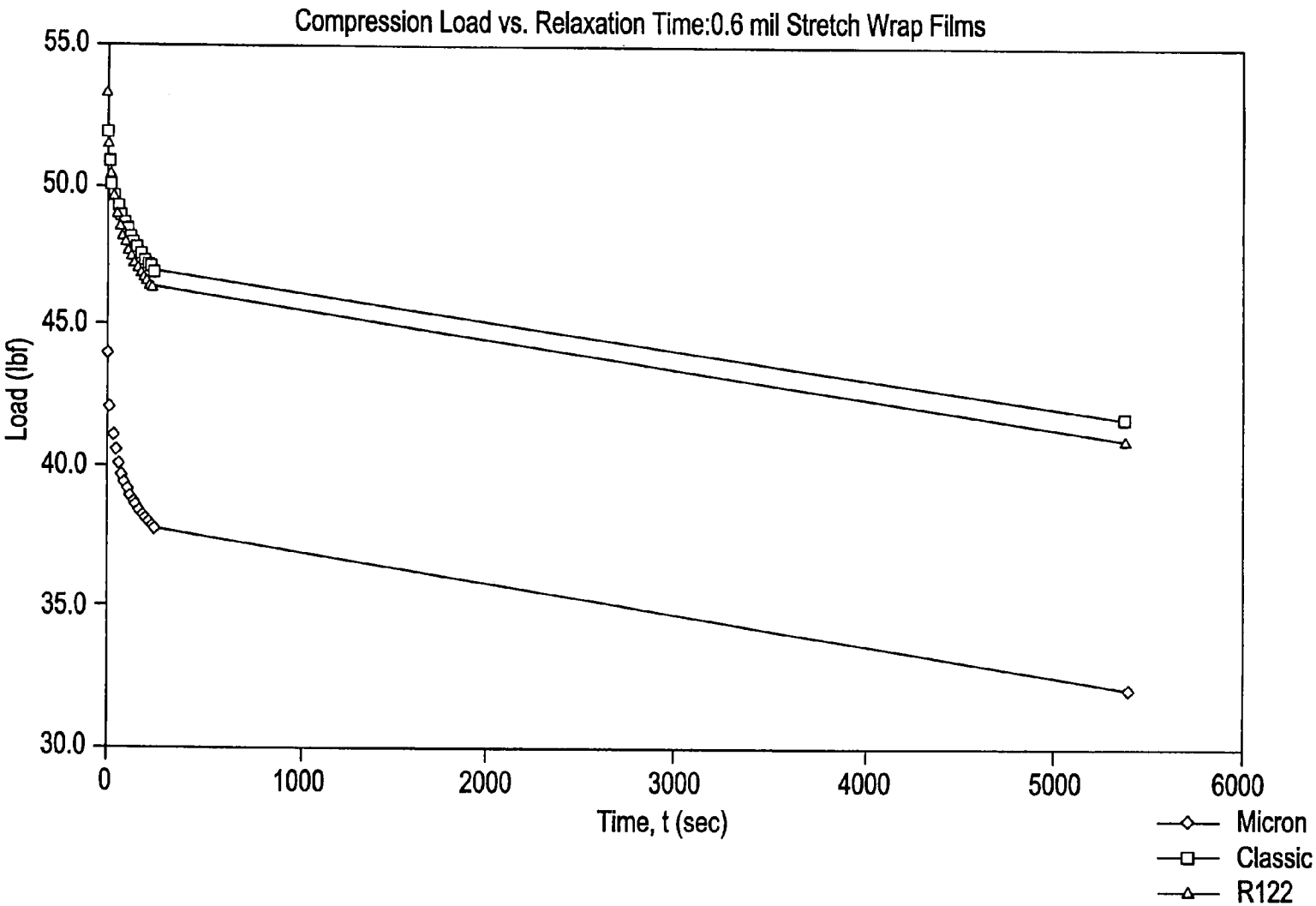
FIG. 14 shows a plot for three film samples of the present technology showing compression load v. relaxation time.
Figure 15:
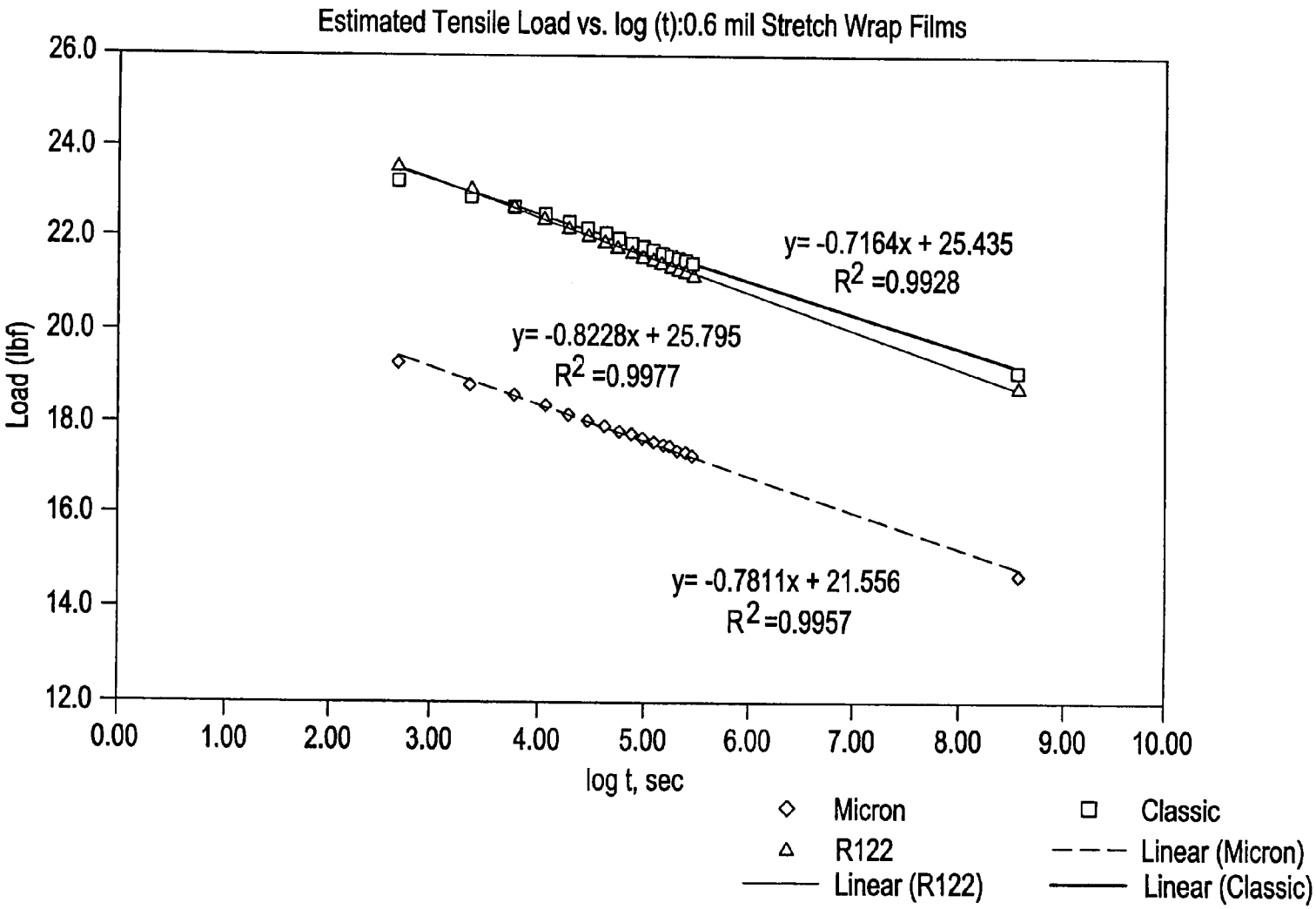
FIG. 15 shows a plot of estimated tension load versus log time (t) for three 0.6 mil stretch wrap films of the present technology.
Figure 16:
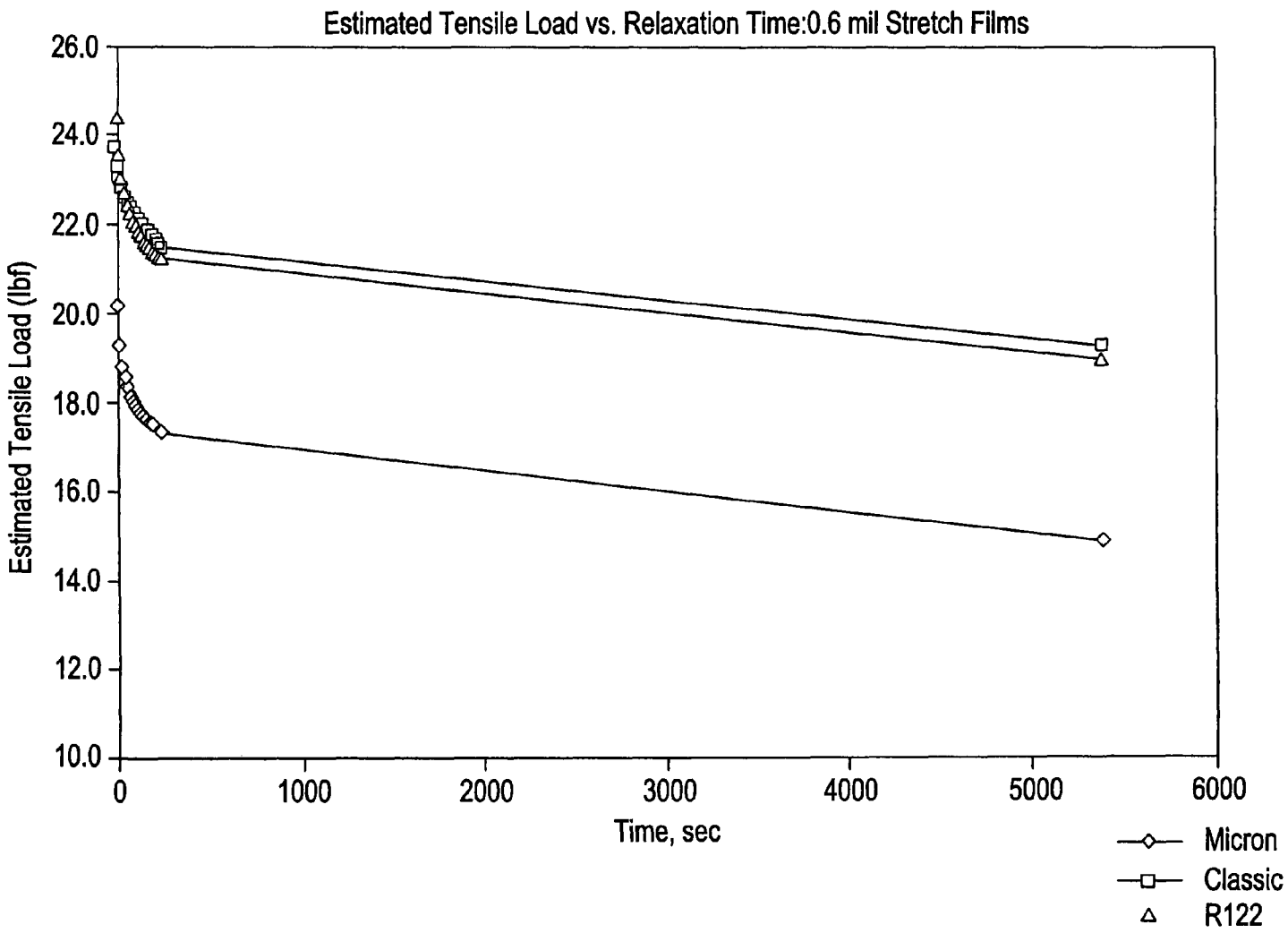
FIG. 16 shows estimated tensile load versus relaxation time for three 0.6 mil stretch films of the present technology.

The Lantech on-pallet tester does not register values for film tension for the tension relaxation over time. Tension, however, was estimated based on the compression values recorded, using resultant forces and the angle at which the film laid onto the cylindrical drum after wrapping the compression load cell (which extended about 3 inches form the drum's outer surface). FIGS. 13 and 14 are plots of the estimated tension data versus time (t) and log t.

Film Behavior Under Tamper Event

An experiment was done to investigate how films initially react to the occurrence of a gross tamper event. This tamper behavior experiment was conducted by exposing three stretch films to gross tampers such as pulling the film away from the pallet or slicing the film with a razor blade (slowly and quickly). The three films used in this testing were the same as those used in the load behavior testing described above, namely Micron, Classic, and R122, all available from Pliant Corporation.

Each of the three films was loaded on a drum in the same manner as was done in the load behavior testing described above. After allowing 4 minutes (240 sec) for stabilization, each of the films was pulled 6 inches from the pallet on the side opposite the load cell on the drum, and was then released. Compression load measurements were taken while the film was pulled and after release. Each sample was then exposed to a gross tamper event, also on the side opposite the load cell on the drum. The compression load was monitored and recorded. Table 1 provides details regarding the gross tamper events introduced to each film sample, as well as showing the compression load data recorded during the experiment.

TABLE 1

GROSS TAMPER EXPERIMENT DATA

R122 STRETCH FILM

| Initial Load (lb) | Load (lb) @ t = 240 sec | Film Pulled 6" from Pallet | Film Released After Pull | Film Cut Slowly w/Razor 3-4" Slit |
|---|---|---|---|---|
| 53.4 | 46.5 | 49.0 | 46.0 | Load dropped from stable |

MICRON STRETCH FILM

| | Initial Load (lb) | Load (lb) @ t = 240 sec | Film Pulled 6" from Pallet | Film Released After Pull | Film Cut Slowly w/Razor 6" Slit |
|---|---|---|---|---|---|
| Run 1 | 43 | 37.2 | 38.5 | 37 | Load dropped from stable |
| Run 2 | 42.2 | 36.7 | — | — | Load = 0 film broke away |

CLASSIC STRETCH FILM

| | Initial Load (lb) | Load (lb) @ t = 240 sec | Film Pulled 6" from Pallet | Film Released After Pull | Film Cut w/Razor 8" Slit |
|---|---|---|---|---|---|
| Run 1 | 52.1 | 46.5 | Film Broke | — | — |
| Run 2 | 51.4 | 46 | — | — | Load dropped from stable |
| Run 3 | 51.7 | 46.6 | — | — | Load = 0 film broke away |

In pulling the samples away from the drum, the Micron film required more force to pull, and in Run 1 using Classic film, the film was torn in the process of attempting to pull it away from the drum 6 inches. Because the Classic film broke during the first attempt to pull it away from the drum, the film was not pulled away from the drum in Runs 2 and 3 using Classic film samples.

With respect to the tamper events, the tamper event for the R122 sample consisted of the film being cut very slowly until change in compression was recognized or detected. The tamper events for Run 1 using Micron film and Run 2 using Classic film also consisted of the film being cut very slowly until change in compression was recognized or detected. In Run 2 using Micron film and Run 3 using Classic film, the tamper event consisted of the film being cut quickly, and in both instances the film broke away from the drum immediately.

Conductive Ink Testing

Conductive ink patterns on Classic stretch film from Pliant Corporation were tested for conductivity and behavior under mechanical stressing. Testing was conducted on film samples that had been patterned with conductive ink developed by Nanotechnologies, Inc. in Austin, Tex. The ink was printed on the film samples in a strip about 1 inch wide and about 3 inches long. Before and after photonic curing of the ink, resistivity measurements were taken utilizing both a two and four-point probe for surface resistivity. After curing, the film samples with the conductive ink patterns thereon were stretched to about 50%, about 100%, and about 150%. Surface resistivity measurements were taken at each amount of stretch. Table 2 shows the surface resistivity measurements taken during this experiment.

TABLE 2

SURFACE RESISTIVITY MEASUREMENTS OF CONDUCTIVE PATTERNS ON STRETCH FILM

| Sample | Pre-Cure (2P Probe) kΩ | Pre-Cure (4P Probe) kΩ/□ | Post-Cure (2P Probe) Ω | Post-Cure (4P Probe) Ω/□ | Post-Cure (2P (Probe), 50% Stretch, Ω | Post-Cure (2P Probe), 100% Stretch, Ω | Post-Cure (2P Probe), 150% Stretch, Ω | Post-Cure (2P Probe), After Relaxation, Ω | Post-Cure (4P Probe), After Relaxation, Ω/□ |
|---|---|---|---|---|---|---|---|---|---|
| 1 | 760 | — | 4.6 | 2.87 | — | — | — | — | — |
| 2 | 6000 | — | 45 | 59.9 | — | — | — | — | — |
| 3 | 500 | — | 14 | 30.8 | 55 | 99 | 160 | — | 60.8 |
| 4 | 370 | — | 22 | 37.3 | 72 | 110 | 360 | 200 | 130 |
| 5 | 460 | — | 120 | 37.8 | 500 | 570 | 350 | — | 5.2 |
| 6 | 580 | 4 | 11 | 5.9 | 54 | 107 | 200 | 119 | 56 |
| 7 | 412 | 4 | 16 | 13 | 90 | 190 | 600 | 300 | 118 |
| 8 | 540 | 4 | 3 | 2.9 | 16.5 | 30.5 | 77 | 36 | 38 |
| 9 | 432 | 4 | 6.9 | 4.6 | 29.5 | 180 | 140 | 75 | 41.7 |
| 10 | 400 | 4 | 18.5 | 14.5 | 85 | 150 | 357 | 225 | 83.4 |
| 11 | 460 | 4 | 28 | 31 | 84 | 169 | 395 | 290 | 140 |

As discussed above, stretch films relax over time when applied to a pallet. The 4-point probe resistivity measurements after the film samples with conductive ink cured thereon have been mechanically stressed and relaxed are therefore particularly relevant. Measurements such as those obtained in this experiment can be used in determining the detection capabilities of tamper event detection systems of the present technology. The greatest resistivity measurement after relaxation should still be low enough to form a complete circuit within the tamper detection system.

Conductive Ink Printing on Shrink Film

Two lanes of conductive ink, each ½ an inch wide, were printed onto a shrink film, with their centers being 7 inches apart. The shrink film was a Bullseye™ shrink film, having the code number X3-222-1803. The printing was accomplished using a 30 BCM gravure cell. The ink was Metalon™ FS-066 ink, commercially available from Novecentix, which is a solvent based ink having a silver content of 30% silver by weight. The printed film was subjected to a drying chamber to dry the ink, and to strobe lights to cure the nanoparticle silver ink. The resistance along the lanes of ink was measured over a 5 inch distance, and the surface resistivity was calculated in terms of Ohms per ½ inch square (½ inch wide and ½ inch long). The surface resistivity was 12 Ohms per ½ inch square or less, and it was determined that it would be possible to print a circuit of less than 10 Megaohms.

Tamper Event Detection

Hand Wrapped Pallet

A pallet was securely wrapped with a primary wrapping of stretch film, and then film with a printed conductive ink pattern applied thereon was hand wrapped over the primary wrapping. The ink contained conductive silver particles and was obtained from Nanotechnologies, Incorporated, in Austin Tex. A conductive strip was applied to connect two ends of the conductive ink pattern to create a continuous conductive loop.

In order to complete the tamper evident circuit, an RFID tag (containing a continuity testing circuit) was placed in contact with the conductive ink pattern towards the top of the wrapped pallet. The tamper evident circuit in this experiment, covered essentially the entire height of the pallet. Once the RFID had been attached to the circuit, a handheld RFID reader was used to confirm that the tag was properly transmitting a data signal. After confirmation was received with the RFID reader, a gross tamper was induced on the pallet that broke all the way through at least two sections of the conductive ink trace making up the conductive ink pattern. The circuit was broken, and the RFID tag no longer transmitted data.

Machine Wrapped Pallet

A pallet was securely wrapped with a primary wrapping of stretch film, and then film with a printed conductive ink pattern applied thereon was machine wrapped over the primary wrapping. The machine was set to stretch the film by 25%, which was enough to maintain the pallet load.

Instead of a large gross tamper being used to disrupt several conductive traces on the pallet, as was done in the hand wrapped experiment described above, a cut through only a single section of the conductive ink trace was induced. The cut did disable the RFID tag, causing it to stop data transmission.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A system for detecting a tamper event in a film comprising:

a. at least one stretch film having an electrically conductive ink pattern applied thereto wherein the electrically conductive ink pattern remains electrically conductive when the stretch film is at a percent stretch of about 1% to about 400%;

b. at least one sensor in operative contact with the conductive ink pattern;

c. at least one reader in operative communication with the sensor for detecting a tamper event; and d. at least one power source that generates a current through the conductive ink pattern.

2. The system of claim 1, wherein the power source is incorporated in the sensor.

3. The system of claim 1, wherein the sensor transmits a signal when the current flows through a closed circuit comprising the conductive ink pattern.

4. The system of claim 3, wherein the sensor does not transmit a signal when the resistance of the closed circuit comprising the conductive ink pattern is greater than about 10 mega-ohms.

5. The system of claim 1, wherein the stretch film is a multilayer film.

6. The system of claim 1, wherein each layer of the multilayer stretch film comprises at least one olefin based polymer.

7. The system of claim 1, wherein the conductive ink pattern comprises at least two parallel continuous traces or a grid.

8. The system of claim 1, wherein the conductive ink pattern is photonically cured onto the flexible film.

9. The system of claim 1, wherein the conductive ink pattern remains conductive when the film is at a percent stretch from about 75% to about 150% stretch.

10. The system of claim 3, wherein the sensor is at least one radio frequency identification tag.

11. A system for detecting a tamper event in a film comprising:

a. at least one film having an electrically conductive material applied thereto wherein the electrically conductive material remains electrically conductive when the film is at a percent stretch of about 1% to about 400%;

b. at least one sensor in operative contact with the conductive material;

c. at least one reader in operative communication with the sensor for detecting a tamper event; and d. at least one power source that generates a current through the conductive material.

12. The system of claim 11, wherein the film is a stretch film, a shrink film or a stretch hooder.

13. The system of claim 11, wherein the conductive material comprises a conductive ink applied on or within the film.

14. The system of claim 11, wherein the conductive material comprises at least one conductive metal wire or a conductive metal foil.

* * * * *